US011410787B2

(12) United States Patent
Araki et al.

(10) Patent No.: US 11,410,787 B2
(45) Date of Patent: Aug. 9, 2022

(54) MOVABLE CABLE

(71) Applicant: FURUKAWA ELECTRIC CO., LTD., Tokyo (JP)

(72) Inventors: Akiyoshi Araki, Tokyo (JP); Hiroshi Kaneko, Tokyo (JP); Yoshiaki Ogiwara, Tokyo (JP)

(73) Assignee: FURUKAWA ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 16/961,451

(22) PCT Filed: Dec. 7, 2018

(86) PCT No.: PCT/JP2018/045039
§ 371 (c)(1),
(2) Date: Jul. 10, 2020

(87) PCT Pub. No.: WO2019/138748
PCT Pub. Date: Jul. 18, 2019

(65) Prior Publication Data

US 2021/0082596 A1 Mar. 18, 2021

(30) Foreign Application Priority Data

Jan. 12, 2018 (JP) ..... JP2018-003793

(51) Int. Cl.
*H01B 1/02* (2006.01)
*H01B 5/08* (2006.01)
(Continued)

(52) U.S. Cl.
CPC ..... *H01B 1/023* (2013.01); *H01B 5/10* (2013.01); *H01B 7/041* (2013.01)

(58) Field of Classification Search
CPC ..... H01B 1/023; H01B 5/08; H01B 7/08
See application file for complete search history.

(56) References Cited

U.S. PATENT DOCUMENTS 4,861,947 A * 8/1989 Altermatt ..... G02B 6/4416 174/113 C
5,826,456 A * 10/1998 Kawazoe ..... C22F 1/047 72/253.1

(Continued)

FOREIGN PATENT DOCUMENTS

CN 2906841 Y 5/2007
CN 104051057 A 9/2014

(Continued)

OTHER PUBLICATIONS

International Search Report dated Mar. 12, 2019 in PCT/JP2018/045039 filed on Dec. 7, 2018, citing documents AK and AN-AS therein, 2 pages (Continued)

*Primary Examiner* — Chau N Nguyen
(74) *Attorney, Agent, or Firm* — Oblon, McClelland, Maier & Neustadt, L.L.P.

(57) ABSTRACT

The present invention provides a movable cable, which has strength that is at least equal to conventional movable cables while having excellent flexural fatigue resistance and flexibility as well as being lightweight. This movable cable 10 has an electric conductor therein. The conductor comprises a first conductor 2 made of a specific aluminum alloy material wherein: the alloy composition contains, in mass %, 0.05-1.8% Mg, 0.01-2.0% Si, 0.01-1.5% Fe, and at least a total of 0.00-2.00% of one element selected from the group consisting of Cu, Ag, Zn, Ni, Co, Au, Mn, Cr, V, Zr, Ti and Sn, the balance being Al and unavoidable impurities; the crystal grains have a fiber-like metal structure in which the crystal grains all extend in one direction; and in a cross-section parallel to the one direction, the average crystal grain dimension perpendicular to the longitudinal direction is 400 nm or less. The ratio X of the area of the first conductor 2

(Continued)

in the whole conductor of the movable cable 10 is in the range of 10-100%.

6 Claims, 11 Drawing Sheets

(51) Int. Cl.
*H01B 7/08* (2006.01)
*H01B 5/10* (2006.01)
*H01B 7/04* (2006.01)

(56) References Cited

U.S. PATENT DOCUMENTS

| | | | | |
|---|---|---|---|---|
| 10,763,000 | B1 * | 9/2020 | Argibay | C23C 14/16 |
| 10,808,299 | B2 * | 10/2020 | Kaneko | H01B 1/023 |
| 10,902,966 | B2 * | 1/2021 | Kaneko | C22C 21/14 |
| 2012/0267141 | A1 | 10/2012 | Kamiyama et al. | |
| 2013/0284488 | A1 | 10/2013 | Yabuki | |
| 2014/0069688 | A1 | 3/2014 | Taniguchi | |
| 2015/0371733 | A1 * | 12/2015 | Cantz | H01B 7/0009 174/23 R |
| 2018/0171439 | A1 * | 6/2018 | Kobayashi | H01B 1/023 |
| 2019/0127826 | A1 | 5/2019 | Kaneko et al. | |
| 2019/0136351 | A1 | 5/2019 | Kaneko et al. | |
| 2020/0040432 | A1 | 2/2020 | Kaneko | |
| 2021/0082596 | A1 | 3/2021 | Araki et al. | |

FOREIGN PATENT DOCUMENTS

| | | | |
|---|---|---|---|
| CN | 111263825 | A | 6/2020 |
| EP | 3 604 580 | A1 | 2/2020 |
| JP | 63-145725 | A | 6/1988 |
| JP | 6-283037 | A | 10/1994 |
| JP | 2009-152141 | A | 7/1999 |
| JP | H11-185540 | A | 7/1999 |
| JP | 2001 -303220 | A | 10/2001 |
| JP | 2004-134212 | A | 4/2004 |
| JP | 2006-196375 | A | 7/2006 |
| JP | 2006-307307 | A | 11/2006 |
| JP | 2007-16308 | A | 1/2007 |
| JP | 4477295 | B2 | 6/2010 |
| JP | 2010-280969 | A | 12/2010 |
| JP | 2012-119073 | A | 6/2012 |
| JP | 2013-152843 | A | 8/2013 |
| JP | 2013-235704 | A | 11/2013 |
| JP | 2014/091867 | A | 5/2014 |
| JP | 2016-225245 | A | 12/2016 |
| JP | 6356365 | B2 | 7/2018 |
| JP | 6410967 | B2 | 10/2018 |
| WO | WO 2013/146762 | A1 | 10/2013 |
| WO | WO 2016/199564 | * | 12/2016 |

OTHER PUBLICATIONS

Notice of Reasons for Rejection dated Jun. 18, 2019 in Japanese Patent Application No. 2019-516561 (with partial English translation), citing documents AK, AN-AS therein, 2 pages.

Extended European Search Report dated Apr. 16, 2021 in European Patent Application No. 18899235.6, citing document AO therein, 7 pages.

Combined Chinese Office Action dated Mar. 2, 2021 in Chinese Patent Application No. 201660069266.8 (with unedited computer generated English translation), citing documents AP through AR therein, 13 pages.

International Search Report dated Mar. 26, 2019 in PCT/JP2018/046820 (with English Translation), citing documents AO and AP therein, 4 pages Notification of Reasons for Refusal dated Jun. 18, 2019 in corresponding Japanese Patent Application No. 2019-518118, 3 pages.

Combined Chinese Office Action and Search Report dated Mar. 10, 2021 in corresponding Chinese Patent Application No. 201880069254.5 (with English Translation and English Translation of Category of Cited Documents), citing documents AP and AQ therein, 16 pages.

Office Action dated Aug. 25, 2021 in corresponding Chinese Patent Application No. 201880069254.5 (with English Translation), citing documents AQ and AR therein, 16 pages.

Combined Chinese Office Action and Search Report dated Sep. 26, 2021 in corresponding Chinese Patent Application No. 201880069254.5 (with English Translation and English Translation of Category of Cited Documents), 26 pages.

Mori, N., "Overhead Cables and Underground Cables," Journal of the Electrical Society, Jan. 22, 1981, (with English Translation), 6 pages Office Action issued in Korean Patent Application No. KR10-2020-7010792, dated Feb. 21, 2022, with machine translation, 11 pages.

Chinese Office Action in related Chinese patent application No. CN201880069254.5, dated Dec. 30, 2021, with machine translation, 14 pages.

Decision of Refusal issued in related Chinese Patent Application No. CN201880069254.5, dated Apr. 19, 2022, with English machine translation, 17 pages.

* cited by examiner

MOVABLE CABLE

TECHNICAL FIELD

The present invention relates to a movable cable that is subjected to repeated deformation, such as an elevator cable, a robot cable, a cabtire cable, an electrical wire for construction machines, or an electrical wire for industrial use.

BACKGROUND ART

Conventionally, copper-based materials have been widely used for movable cables that transmit electric power or signals, such as elevator cables, robot cables, and cabtire cables. Recently, an investigation has been conducted on the substitution with aluminum-based materials which have smaller specific gravities and higher coefficients of thermal expansion compared to copper-based materials, and which also have relatively satisfactory conductivity for electricity and heat and excellent corrosion resistance.

However, pure aluminum-based materials have problems that the number of times of flexural fatigue fracture (hereinafter, also referred to as "flexural fatigue resistance") is low compared to copper-based materials, the materials cannot withstand the repeated movement of several hundred thousand times to several ten million times exerted on the movable cables, and there is a risk of breaking of wire. Furthermore, aluminum alloy materials of 2000 series (Al—Cu-based) and 7000 series (Al—Zn—Mg-based), which are aluminum alloy materials that utilize precipitation strengthening and have relatively high flexural fatigue resistance, have problems such as inferior corrosion resistance and stress corrosion cracking resistance as well as low electrical conductivity. Aluminum alloy materials of 6000 series having relatively excellent conductivity for electricity and heat and corrosion resistance are considered to have high flexural fatigue resistance among aluminum-based alloy materials; however, the flexural fatigue resistance is not sufficient, and further enhancement of the flexural fatigue resistance is desirable.

Regarding the means for enhancing the flexural fatigue resistance of aluminum alloys for electricity conduction, for example, a method of forming fine crystal grains according to a high deformation method called ECAP method (for example, Patent Document 1) has been suggested. However, in the ECAP method, the aluminum alloy materials thus produced have short lengths, and industrial practical uses is difficult. Furthermore, an aluminum alloy material produced using the ECAP method described in Patent Document 1 has superior flexural fatigue resistance compared to pure aluminum materials; however, the flexural fatigue resistance is only about 10 times higher, and it cannot be said that the aluminum alloy material has sufficient flexural fatigue resistance to the extent that can be used for a long time period.

Furthermore, in movable cables, particularly in elevator cables, since the own weight of the cable as a whole is exerted to the conductor, and breaking of wire is likely to occur, the conductor is required to have the strength to withstand the own weight. However, pure copper materials have low strength, and the elevating stroke is restricted. Furthermore, it has also been suggested to use copper alloy materials in order to increase strength (for example, Patent Documents 2 and 3); however, when a copper alloy material is used, it is necessary to supplement the electrical conductivity that is inferior compared to pure copper materials, by making the conductor diameter large or increasing the number of conductors, and therefore, there are problems such as an increase in the cable weight caused by an increase in the conductor weigh, or deterioration of flexibility.

In order to reduce the cable weight, it can be considered to use an aluminum alloy material for the conductors. However, since conventional pure aluminum materials for conductor and aluminum alloy materials have tensile strength lower than or equal to that of pure copper materials, those materials have low strength and cannot withstand the own weight of cable, and there is a risk of wire breaking.

Furthermore, described in Patent Document 4 is a copper-coated aluminum alloy wire having increased strength, which is obtained by coating a core material of an Al—Fe—Mg—Si-based aluminum alloy with copper and subjecting the wire to cold working. However, in the copper-coated aluminum alloy wire described in Patent Document 4, since a copper-based material that is liable to plastic deformation because of its low elastic limit exists in the surface layer where bending strain is large, there is a problem of having inferior flexural fatigue resistance, such as that cracks are easily generated at the surface of the copper coating layer as a result of repeating of flexural deformation, and that the compound formed in the core material of the aluminum alloy and the copper coating layer serves as the originating points of cracks.

In order to construct a cable that withstands its own weight, conventionally, it is general to use a tension member as a member that constitutes the cable. However, regarding the tension member, since a wire rope made of steel is generally used, the cable weight increases. Furthermore, there is also a problem that since the cable is stiffened due to high elastic modulus, the workability for cable laying becomes poor. Moreover, since most of the own weight of the cable is applied to the tension member, the moment of rotation is applied to the direction in which the twist of the tension member comes loose, and there is a problem that in a round cable, the cable rotates and causes distortion, while in a flat cable, the cable is deformed.

Patent Document 1: PCT International Publication No. WO2013/146762

Patent Document 2: Japanese Unexamined Patent Application, Publication No. 2006-307307

Patent Document 3: Japanese Unexamined Patent Application, Publication No. 2013-152843

Patent Document 4: Japanese Unexamined Patent Application, Publication No. 2010-280969

DISCLOSURE OF THE INVENTION

Problems to be Solved by the Invention

An object of the present invention is to provide a movable cable that has equal or higher strength compared to conventional movable cables, has excellent flexural fatigue resistance and flexibility, and is lightweight.

Means for Solving the Problems

The gist configurations of the present invention are as follows.

[1] A movable cable having a conductor therein, the conductor including a first conductor formed from a specific aluminum alloy material having an alloy composition containing, by mass %, 0.05% to 1.8% of Mg, 0.01% to 2.0% of Si, 0.01% to 1.5% of Fe, and 0.00% to 2.00% in total of one or more elements selected from the group consisting of Cu, Ag, Zn, Ni, Co, Au, Mn, Cr, V, Zr, Ti, and Sn, with the balance being Al and unavoidable impurities, the specific aluminum alloy material having a fiber-like metal structure in which crystal grains extend to be aligned in one direction, and in a cross-section parallel to the one direction, an average value of a dimension perpendicular to a longitudinal direction of the crystal grains is 400 nm or less, wherein an area proportion occupied by the first conductor in the whole conductor of the movable cable as viewed from a transverse cross-section of the movable cable is in a range of 10% to 100%.

[2] The movable cable as described in the above item [1], wherein the conductor includes a first insulation coated core obtained by twisting a plurality of first conductors, and insulative coating their twisted first conductors.

[3] The movable cable as described in the above item [1], wherein the conductor includes a second insulation coated core obtained by mixing a plurality of first conductors and a plurality of second conductors formed from a metal material or an alloy material selected from the group consisting of copper, copper alloy, aluminum, and aluminum alloy, twisting their mixed conductors, and insulative coating their twisted first conductors.

[4] The movable cable as described in the above item [1], wherein the conductor includes: a first insulation coated core obtained by twisting a plurality of first conductors, and insulative coating their twisted first conductors; and a second insulation coated core obtained by mixing a plurality of first conductors and a plurality of second conductors formed from a metal material or an alloy material selected from the group consisting of copper, copper alloy, aluminum, and aluminum alloy, twisting their mixed conductors, and insulative coating their twisted conductors.

[5] The movable cable as described in the above item [2], [3], or [4], wherein the conductor further includes a third insulation coated core obtained by twisting a plurality of second conductors formed from a metal material or an alloy material selected from the group consisting of copper, copper alloy, aluminum, and aluminum alloy, and insulative coating their twisted second conductors.

[6] The movable cable as described in the above item [3], [4], or [5], wherein the first conductor and the second conductor have the same dimension as viewed from a transverse cross-section of the movable cable.

[7] The movable cable as described in the above item [3], [4], or [5], wherein the first conductor and the second conductor have different dimensions as viewed from a transverse cross-section of the movable cable.

[8] The movable cable as described in any one of the above items [3] to [7], wherein the movable cable is composed of one or more cables, each cable comprising: one or more composite twisted wires formed by twisting a plurality of insulation coated cores which include at least one insulation coated core of the first insulation coated core and the second insulation coated core among the first insulation coated core, the second insulation coated core, and the third insulation coated core such that the area proportion of the first conductor reaches one level or higher; and a sheath insulative coating the composite twisted wires so as to include them.

[9] The movable cable as described in any one of the above items [1] to [8], wherein the specific aluminum alloy material has an alloy composition containing, by mass %, 0.2% to 1.8° of Mg, 0.2% to 2.0% of Si, 0.01% to 1.5% of Fe, and 0.00% to 2.00% in total of one or more elements selected from the group consisting of Cu, Ag, Zn, Ni, Co, Au, Mn, Cr, V, Zr, Ti, and Sn, with the balance being Al and unavoidable impurities.

[10] The movable cable as described in any one of the above items [1] to [9], wherein the movable cable is an elevator cable.

[11] The movable cable as described in any one of the above items [1] to [9], wherein the movable cable is a robot cable.

[12] The movable cable as described in any one of the above items [1] to [9], wherein the movable cable is a cabtire cable.

Effects of the Invention

According to the present invention, there is provided a movable cable having a conductor therein, the conductor including a first conductor formed from a specific aluminum alloy material having an alloy composition containing, by mass %, 0.05% to 1.8% of Mg, 0.01% to 2.0% of Si, 0.01% to 1.5% of Fe, and 0.00% to 2.00% in total of one or more elements selected from the group consisting of Cu, Ag, Zn, Ni, Co, Au, Mn, Cr, V, Zr, Ti, and Sn, with the balance being Al and unavoidable impurities, the specific aluminum alloy material having a fiber-like metal structure in which crystal grains extend to be aligned in one direction, and in a cross-section parallel to the one direction, the average value of a dimension perpendicular to the longitudinal direction of the crystal grains is 400 nm or less, wherein the area proportion occupied by the first conductor in the whole conductor of the movable cable as viewed from a transverse cross-section of the movable cable is in the range of 10% to 100%, and thereby, a movable cable that has equal or higher strength compared to conventional movable cables, has excellent flexural fatigue resistance and flexibility, and is lightweight, can be provided.

PREFERRED MODE FOR CARRYING OUT THE INVENTION

Hereinafter, the present invention will be described in detail based on embodiments.

The movable cable of a first embodiment according to the present invention is a movable cable having a conductor therein, the conductor including a first conductor formed from a specific aluminum alloy material having an alloy composition containing, by mass %, 0.05% to 1.8% of Mg, 0.01% to 2.0% of Si, 0.01% to 1.5% of Fe, and 0.00% to 2.00° in total of one or more elements selected from the group consisting of Cu, Ag, Zn, Ni, Co, Au, Mn, Cr, V, Zr, Ti, and Sn, with the balance being Al and unavoidable impurities, the specific alloy material having a fiber-like metal structure in which crystal grains extend to be aligned in one direction, and in a cross-section parallel to the one direction the average value of a dimension perpendicular to the longitudinal direction of the crystal grains is 400 nm or less, wherein the area proportion occupied by the first conductor in the whole conductor of the movable cable as viewed from a transverse cross-section of the movable cable is in the range of 10% to 100%.

Here, when it is said that the area proportion of the movable cable is "100%", it means that all the conductors constituting the movable cable are the above-mentioned specific aluminum alloy material.

Furthermore, the "movable cable" in the present specification is a cable having a conductor therein and having a single or a plurality of insulation coated core(s) as a constituent element. Furthermore, the term "conductor" as used herein includes both the first conductor and a second conductor that will be described below. Meanwhile, in a case in which it is described simply as "conductor" below, it should be construed to mean to include both the first conductor and the second conductor without particularly distinguishing the two. The "conductor" refers to copper, copper alloy, aluminum, and aluminum alloy, all of which are positioned inside the cable, while the shape of a transverse cross-section thereof is preferably a circular shape or a rectangular shape (plate shape); however, the shape is not particularly limited, and various shapes can be adopted. Furthermore, the "insulation coated core" is a product obtained by making the conductor into a twisted wire and then insulative coating the resultant, and it is also acceptable to form a twisted wire by twisting a plurality of conductors. Meanwhile, regarding the twisted wire, any known twisting method can be used, and either concentric twisting or assembled twisting may be used.

(1) First Conductor (Specific Aluminum Alloy Material)

Figure 1A:
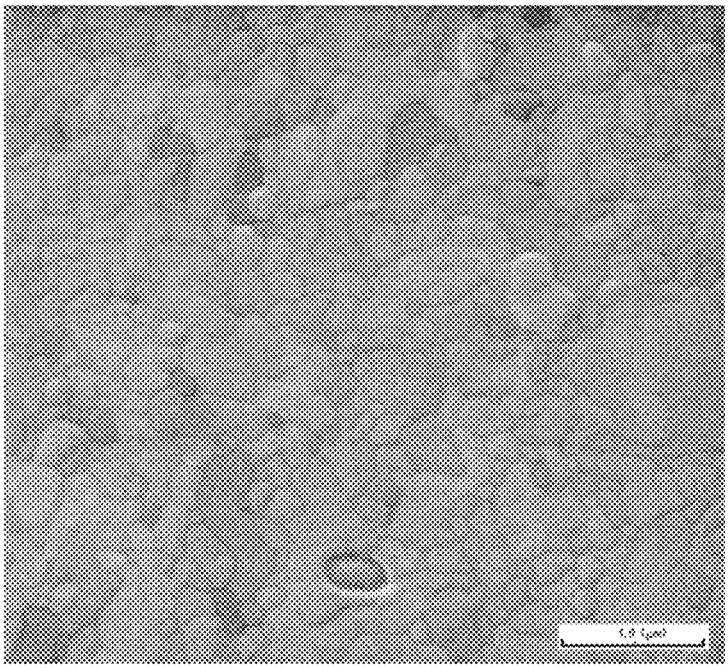
FIG. 1 is a diagram showing an example of a SIM image when the metal structure of a first conductor (specific aluminum alloy material) constituting the movable cable according to the present invention, and FIG. 1(*a*) is a cross-section perpendicular to the direction of extension (one direction) of crystal grains, while FIG. 1(*b*) is a cross-section parallel to the direction of extension (one direction) of crystal grains.
Figure 1B:
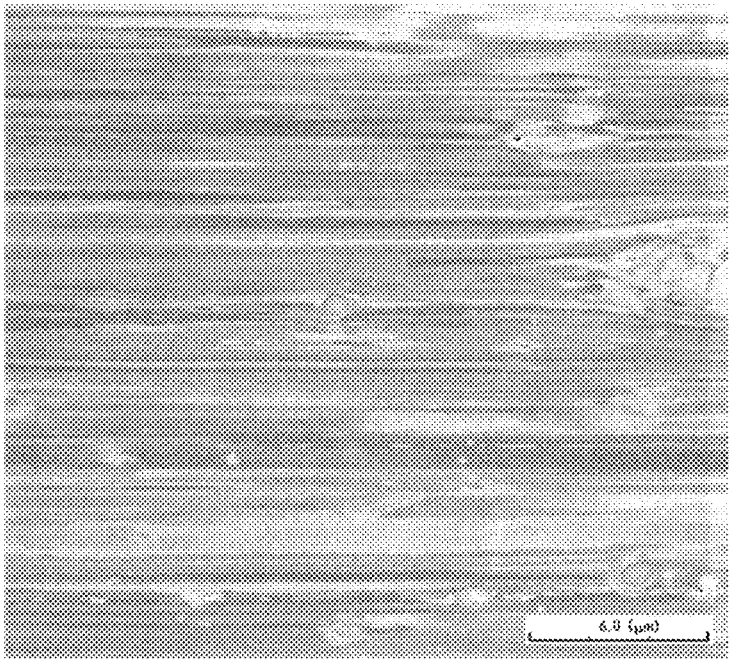

The crystal grain state of the first conductor (specific aluminum alloy material) of a representative embodiment according to the present invention and action thereof will be explained using FIG. 1.

The first conductor (specific aluminum alloy material) has an alloy composition containing, by mass %, 0.05° to 1.8% of Mg, 0.01% to 2.0% of Si, 0.01% to 1.5% of Fe, and 0.00% to 2.00% in total of one or more elements selected from the group consisting of Cu, Ag, Zn, Ni, Co, Au, Mn, Cr, V, Zr, Ti, and Sn, with the balance being Al and unavoidable impurities, has a fiber-like metal structure in which crystal grains extend to be aligned in one direction, and in a cross-section parallel to the one direction, the average value of a dimension perpendicular to the longitudinal direction of the crystal grains is 400 nm or less.

Here, among the element components of the alloy composition described above, an element component for which the lower limit of the content range is described as "0.00%" means a component that is optionally added as appropriate to the aluminum alloy material according to necessity. That is, in a case in which the element component is "0.00%", it means that the element component is not included in the aluminum alloy material or is included at a content that is less than the detection limit.

Furthermore, in the present specification, the term "crystal grain" refers to a portion surrounded by orientation difference boundaries. Here, the term "orientation difference boundary" refers to a boundary that at which contrast (channeling contrast) discontinuously changes when the metal structure is observed by scanning transmission electron microscopy (STEM), scanning ion microscopy (SIM), or the like. Furthermore, the dimension perpendicular to the longitudinal direction in which the crystal grains extend corresponds to the interval of the orientation difference boundaries.

The specific aluminum alloy material has, in particular, a fiber-like metal structure in which crystal grains extend to be aligned in one direction. Furthermore, the specific aluminum alloy material has, as shown in FIG. 1, a fiber-like structure in which crystal grains having an elongated shape are in a state of extending to be aligned in one direction. Such crystal grains having an elongated shape are significantly different from conventional fine crystal grains or flat crystal grains that simply have a large aspect ratio. That is, the crystal grains of the present invention have an elongated shape like fibers, and the average value of the crystal grain diameter in a cross-section perpendicular to the longitudinal direction thereof is 400 nm or less. A fiber-like metal structure in which such fine crystal grains extend to be aligned in one direction can be said to be a novel metal structure that does not exist in conventional aluminum alloy materials.

Since the specific aluminum alloy material has a fiber-like metal structure in which crystal grains extend to be aligned in one direction, and in a cross-section parallel to the one direction, the average value of the crystal grain diameter in a cross-section perpendicular to the longitudinal direction of the crystal grains is controlled to be 400 nm or less, high strength comparable to that of iron-based materials or copper-based materials and excellent flexural fatigue resistance can be achieved.

Furthermore, the metal structure of the specific aluminum alloy material is fiber-like form and is in a state in which crystal grains having an elongated shape extend in a fiber-like form to be aligned in one direction. Here, the "one direction" corresponds to the working direction of the aluminum alloy material, and particularly in a case in which the first conductor (specific aluminum alloy material) is produced by wire drawing, the "one direction" corresponds to the direction of wire drawing.

Furthermore, the one direction preferably corresponds to the longitudinal direction of the aluminum alloy material. That is, usually, as long as an aluminum alloy material is not divided into individual pieces to have a dimension shorter than the dimension perpendicular to the working direction of the material, the working direction corresponds to the longitudinal direction of the material. For example, in a case in which the aluminum alloy material is produced by wire drawing, the one direction corresponds to the direction of wire drawing of the aluminum alloy material.

Furthermore, in a cross-section (transverse cross-section) of the aluminum alloy material perpendicular to the longitudinal direction in which crystal grains extend, the average crystal grain diameter thereof is preferably 400 nm or less, more preferably 330 nm or less, even more preferably 250 nm or less, particularly preferably 180 nm or less, and still more preferably 150 nm or less. In such a fiber-like metal structure of the aluminum alloy material, since the particle size of the crystal grains extending in one direction (dimension perpendicular to the longitudinal direction in which the crystal grains extend) is small, crystal slip concomitant to the load stress or concomitant to repeated deformation can be effectively suppressed, and strength higher than conventional cases and flexural fatigue resistance superior to conventional cases can be achieved. Meanwhile, as the lower limit of the average crystal grain diameter is smaller, it is more preferable for realizing high strength and flexural fatigue resistance; however, as a limit in view of production or from a physical aspect, the lower limit is, for example, 20 nm.

Furthermore, in a cross-section of the specific aluminum alloy material parallel to the longitudinal direction in which crystal grains extend, the dimension in the longitudinal direction measured along the longitudinal direction of the crystal grains existing in the specific aluminum alloy material is not particularly specified; however, the dimension is preferably 1,200 nm or more, more preferably 1,700 nm or more, and even more preferably 2,200 nm or more.

Furthermore, in a cross-section of the specific aluminum alloy material parallel to the longitudinal direction in which crystal grains extend, the ratio L1/L2 between the longitudinal direction dimension L1 measured along the longitudinal direction and the lateral direction dimension L2 measured along a direction perpendicular to the longitudinal direction, that is, the aspect ratio, is preferably 10 or greater, and more preferably 20 or greater. When the aspect ratio L1/L2 is in the above-described range, since the probability of existence of crystal grain boundaries having a possibility of serving as the starting points of fatigue fracture at the surface of the specific aluminum alloy material is decreased, the flexural fatigue resistance is enhanced.

As a mechanism by which the state of the crystal grain enhances strength and flexural fatigue resistance, for example, include: (i) a mechanism in which since the crystal grains have a fiber-like form with a large aspect ratio, there are few grain boundaries on the surface that are the starting points of the crack, and therefore, the crack does not easily occur; (ii) a mechanism in which since the lateral direction dimension of the crystal grains is small, it is difficult for dislocations to move, and therefore, all or most of the loaded strain can be absorbed as elastic strain; and (iii) a mechanism in which the step of forming the starting points of the crack on the surface of the aluminum alloy material is hardly generated, and also, when the crack is generated, grain boundaries hinder crack extension, and it is thought that these mechanisms (i) to (iii) act synergistically.

Furthermore, when the crystal grain diameter in the surface layer of the aluminum alloy material is made fine, it is effective for an action of improving flexural fatigue resistance, as well as an action of improving grain boundary corrosion, an action of reducing roughness of the surface of the aluminum alloy material after performing plastic working, an action of reducing sagging or burr at the time of performing shearing, and the like, and there is an effect of generally enhancing the characteristics of the aluminum alloy material.

(2) Alloy Composition of Specific Aluminum Alloy Material

Next, the component composition of the specific aluminum alloy material will be described below together with actions. In the following description, the unit "mass %" will be simply described as "%".

<Mg: 0.05% to 1.8%>

Mg (magnesium) has an action of solid-solutioning into an aluminum base metal and thereby reinforcing the aluminum base metal, and also has an action of making the crystal grains fine. Furthermore, Mg is an element which has an action of enhancing the tensile strength and fatigue life as a result of a synergistic effect with Si or Cu, and has an action of enhancing tensile strength or elongation in a case in which Mg—Si clusters or Mg—Cu clusters are formed as solute atom clusters. However, when the Mg content is less than 0.05%, the above-described operating effects are insufficient, and when the Mg content is more than 1.8°, crystallization products are formed, and workability (wire drawing workability, bending workability, and the like) is deteriorated. Therefore, the Mg content is adjusted to 0.05% to 1.8%, preferably 0.2% to 1.5%, and more preferably 0.4% to 1.0%.

<Si: 0.01% to 2.0%>

Si (silicon) has an action of solid-solutioning into an aluminum base metal and thereby reinforcing the aluminum base metal, and also has an action of making the crystal grains fine. Furthermore, Si is an element which has an action of enhancing tensile strength and fatigue life as a result of a synergistic effect with Mg, and has an action of enhancing the tensile strength and elongation in a case in which Si forms Mg—Si clusters or Si—Si clusters as solute atom clusters. However, when the Si content is less than 0.01%, the above-described operating effects are insufficient, and when the Si content is more than 2.0%, crystallization products are formed, and workability is deteriorated. Therefore, the Si content is adjusted to 0.01% to 2.0%, preferably 0.2% to 1.5%, and more preferably 0.4% to 1.00.

<Fe: 0.01% to 1.5%>

Fe (iron) is crystallized or precipitated as intermetallic compounds with aluminum or essentially added elements, such as Al—Fe-based, Al—Fe—Si-based, and Al—Fe—Si—Mg-based intermetallic compounds, during casting or a homogenization heat treatment. Intermetallic compounds composed mainly of Fe and Al as above are referred to as Fe-based compounds in the present specification. Fe-based compounds contribute to the refinement of crystal grains and also increase tensile strength. Furthermore, Fe has an action of increasing tensile strength by means of Fe that has been solid-solutioned in aluminum. When the Fe content is less than 0.01%, these operating effects are insufficient. When the Fe content is more than 1.5%, the amount of Fe-based compounds becomes too large, and workability is deteriorated. Meanwhile, in a case in which the cooling rate at the time of casting is slow, dispersion of the Fe-based compounds becomes sparse, and the degree of adverse effect becomes high. Therefore, the Fe content is adjusted to 0.01% to 1.5%, preferably to 0.02% to 0.80%, more preferably 0.03% to 0.50%, even more preferably 0.04% to 0.35%, and still more preferably 0.05% to 0.25%.

The specific aluminum alloy material contains Mg, Si, and Fe described above as essentially incorporated components; however, in addition to these elements, for example, one or more elements selected from the group consisting of Cu, Ag, Zn, Ni, Ti, Co, Au, Mn, Cr, V, Zr, and Sn can also be appropriately incorporated as optional components according to the required performance or the like.

<One or More Elements Selected from Group of Cu, Ag, Zn, Ni, Ti, Co, Au, Mn, Cr, V, Zr, and Sn: 0.00° to 2.00° in Total>

Cu, Ag, Zn, Ni, Ti, Co, Au, Mn, Cr, V, Zr, and Sn are all elements that particularly enhance heat resistance. From the viewpoint of sufficiently exhibiting such an effect, it is preferable that the sum of the contents of these optionally added components is adjusted to 0.06° or more. However, when the sum of the contents of these optionally added components is adjusted to more than 2.00%, workability is deteriorated. Therefore, the sum of the contents of one or more elements selected from the group consisting of Cu, Ag, Zn, Ni, Ti, Co, Au, Mn, Cr, V, Zr, and Sn is adjusted to 0.00° to 2.00°, preferably to 0.06% to 2.00%, and more preferably 0.30% to 1.20%. Meanwhile, the contents of these elements may be set to 0.00%. Furthermore, regarding these elements, one kind of element may be added alone, or two or more kinds of elements may be added in combination.

Furthermore, when corrosion resistance in the case of being used in a corrosive environment is considered, it is preferable that the aluminum alloy material contains one or more elements selected from the group consisting of Zn, Ni, Ti, Co, Mn, Cr, V, Zr, and Sn. Furthermore, when the sum of the contents of these elements is less than 0.06%, the effect of corrosion resistance is insufficient. Furthermore, when the sum of the contents of these elements is more than 2.00%, workability is deteriorated. Therefore, from the viewpoint of corrosion resistance, the sum of the contents of one or more elements selected from the group consisting of Zn, Ni, Ti, Co, Mn, Cr, V, Zr, and Sn is preferably 0.06° to 2.00°, and more preferably 0.30% to 1.20%.

<Cu: 0.00% to 2.00%>

Cu is an element that particularly enhances heat resistance. From the viewpoint of sufficiently exhibiting such an effect, it is preferable that the content of Cu is adjusted to 0.06% or more. However, when the content of Cu is adjusted to more than 2.00%, workability is deteriorated, and at the same time, corrosion resistance is deteriorated. Therefore, the content of Cu is preferably 0.00% to 2.00%, more preferably 0.06° to 2.00°, and even more preferably 0.30% to 1.20%. Meanwhile, the content of Cu may be set to 0.00%.

<Ag: 0.00% to 2.00%>

Ag is an element that particularly enhances heat resistance. From the viewpoint of sufficiently exhibiting such an effect, it is preferable that the content of Ag is adjusted to 0.06% or more. However, when the content of Ag is adjusted to more than 2.00%, workability is deteriorated. Therefore, the content of Ag is preferably 0.00% to 2.00%, more preferably 0.06% to 2.00%, and even more preferably 0.30% to 1.20%. Meanwhile, the content of Ag may be set to 0.00%.

<Zn: 0.00% to 2.00%>

Zn is an element that particularly enhances heat resistance. From the viewpoint of sufficiently exhibiting such an effect, it is preferable that the content of Zn is adjusted to 0.06% or more. However, when the content of Zn is adjusted to more than 2.00%, workability is deteriorated. Therefore, the content of Zn is preferably 0.00° to 2.00°, more preferably 0.06% to 2.00%, and even more preferably 0.30% to 1.20%. Meanwhile, the content of Zn may be set to 0.00%. Furthermore, when corrosion resistance in the case of being used in a corrosive environment is considered, it is preferable that the aluminum alloy material contains Zn. Furthermore, when the content of Zn is less than 0.06%, the effect of corrosion resistance is insufficient. Furthermore, when the content of Zn is more than 2.00%, workability is deteriorated. Therefore, from the viewpoint of corrosion resistance, the content of Zn is preferably 0.06° to 2.00°, and more preferably 0.30% to 1.20%.

<Ni: 0.00% to 2.00%>

Ni is an element that particularly enhances heat resistance. From the viewpoint of sufficiently exhibiting such an effect, it is preferable that the content of Ni is adjusted to 0.06% or more. However, when the content of Ni is adjusted to more than 2.00%, workability is deteriorated. Therefore, the content of Ni is preferably 0.00% to 2.00%, more preferably 0.06% to 2.00%, and even more preferably 0.30% to 1.20°. Meanwhile, the content of Ni may be set to 0.00°. Furthermore, when corrosion resistance in the case of being used in a corrosive environment is considered, it is preferable that the aluminum alloy material contains Ni. Furthermore, when the content of Ni is less than 0.06%, the effect of corrosion resistance is insufficient. Furthermore, when the content of Ni is more than 2.00%, workability is deteriorated. Therefore, from the viewpoint of corrosion resistance, the content of Ni is preferably 0.06% to 2.00%, and more preferably 0.30% to 1.20%.

<Co: 0.00% to 2.00%>

Co is an element that particularly enhances heat resistance. From the viewpoint of sufficiently exhibiting such an effect, it is preferable that the content of Co is adjusted to 0.06% or more. However, when the content of Co is adjusted to more than 2.00%, workability is deteriorated. Therefore, the content of Co is preferably 0.00% to 2.00%, more preferably 0.06° to 2.00%, and even more preferably 0.30% to 1.20%. Meanwhile, the content of Co may be set to 0.00%. Furthermore, when corrosion resistance in the case of being used in a corrosive environment is considered, it is preferable that the aluminum alloy material contains Co. Furthermore, when the content of Co is less than 0.06°, the effect of corrosion resistance is insufficient. Furthermore, when the content of Co is more than 2.00%, workability is deteriorated. Therefore, from the viewpoint of corrosion resistance, the content of Co is preferably 0.06% to 2.00%, and more preferably 0.30° to 1.20°.

<Au: 0.00% to 2.00%>

Au is an element that particularly enhances heat resistance. From the viewpoint of sufficiently exhibiting such an effect, it is preferable that the content of Au is adjusted to 0.06% or more. However, when the content of Au is adjusted to more than 2.00%, workability is deteriorated. Therefore, the content of Au is preferably 0.00° to 2.00°, more preferably 0.06% to 2.00%, and even more preferably 0.30% to 1.20%. Meanwhile, the content of Au may be set to 0.00%.

<Mn: 0.00% to 2.00%>

Mn is an element that particularly enhances heat resistance. From the viewpoint of sufficiently exhibiting such an effect, it is preferable that the content of Mn is adjusted to 0.06% or more. However, when the content of Mn is adjusted to more than 2.00%, workability is deteriorated. Therefore, the content of Mn is preferably 0.00% to 2.00%, more preferably 0.06° to 2.00°, and even more preferably 0.30% to 1.20%. Meanwhile, the content of Mn may be set to 0.00%. Furthermore, when corrosion resistance in the case of being used in a corrosive environment is considered, it is preferable that the aluminum alloy material contains Mn. Furthermore, when the content of Mn is less than 0.06°, the effect of corrosion resistance is insufficient. Furthermore, when the content of Mn is more than 2.00%, workability is deteriorated. Therefore, from the viewpoint of corrosion resistance, the content of Mn is preferably 0.06% to 2.00%, and more preferably 0.30° to 1.20°.

<Cr: 0.00% to 2.00%>

Cr is an element that particularly enhances heat resistance. From the viewpoint of sufficiently exhibiting such an effect, it is preferable that the content of Cr is adjusted to 0.06% or more. However, when the content of Cr is adjusted to more than 2.00%, workability is deteriorated. Therefore, the content of Cr is preferably 0.00° to 2.00°, more preferably 0.06% to 2.00%, and even more preferably 0.30% to 1.20%. Meanwhile, the content of Cr may be set to 0.00%. Furthermore, when corrosion resistance in the case of being used in a corrosive environment is considered, it is preferable that the aluminum alloy material contains Cr. Furthermore, when the content of Cr is less than 0.06%, the effect of corrosion resistance is insufficient. Furthermore, when the content of Cr is more than 2.00%, workability is deteriorated. Therefore, from the viewpoint of corrosion resistance, the content of Cr is preferably 0.06° to 2.00°, and more preferably 0.30% to 1.20%.

<V: 0.00% to 2.00%>

V is an element that particularly enhances heat resistance. From the viewpoint of sufficiently exhibiting such an effect, it is preferable that the content of V is adjusted to 0.06% or more. However, when the content of V is adjusted to more than 2.00%, workability is deteriorated. Therefore, the content of V is preferably 0.00% to 2.00%, more preferably 0.06% to 2.00%, and even more preferably 0.30% to 1.20%. Meanwhile, the content of V may be set to 0.00%. Furthermore, when corrosion resistance in the case of being used in a corrosive environment is considered, it is preferable that the aluminum alloy material contains V. Furthermore, when the content of V is less than 0.06%, the effect of corrosion resistance is insufficient. Furthermore, when the content of V is more than 2.00%, workability is deteriorated. Therefore, from the viewpoint of corrosion resistance, the content of V is preferably 0.06% to 2.00%, and more preferably 0.30% to 1.20%.

<Zr: 0.00% to 2.00%>

Zr is an element that particularly enhances heat resistance. From the viewpoint of sufficiently exhibiting such an effect, it is preferable that the content of Zr is adjusted to 0.06% or more. However, when the content of Zr is adjusted to more than 2.00%, workability is deteriorated. Therefore, the content of Zr is preferably 0.00% to 2.00%, more preferably 0.06% to 2.00%, and even more preferably 0.30% to 1.20%. Meanwhile, the content of Zr may be set to 0.00%. Furthermore, when corrosion resistance in the case of being used in a corrosive environment is considered, it is preferable that the aluminum alloy material contains Zr. Furthermore, when the content of Zr is less than 0.06°, the effect of corrosion resistance is insufficient. Furthermore, when the content of Zr is more than 2.00%, workability is deteriorated. Therefore, from the viewpoint of corrosion resistance, the content of Zr is preferably 0.06% to 2.00%, and more preferably 0.30° to 1.20°.

<Ti: 0.00% to 2.00%>

Ti is an element that makes crystals finer at the time of casting and enhances heat resistance. From the viewpoint of sufficiently exhibiting such an effect, it is preferable that the content of Ti is adjusted to 0.005% or more. However, when the content of Ti is adjusted to more than 2.00%, workability is deteriorated. Therefore, the content of Ti is preferably 0.00% to 2.00%, more preferably 0.06% to 2.00%, and even more preferably 0.30% to 1.20%. Meanwhile, the content of Ti may be set to 0.00%. Furthermore, when corrosion resistance in the case of being used in a corrosive environment is considered, it is preferable that the aluminum alloy material contains Ti. Furthermore, when the content of Ti is less than 0.06%, the effect of corrosion resistance is insufficient. Furthermore, when the content of Ti is more than 2.00%, workability is deteriorated. Therefore, from the viewpoint of corrosion resistance, the content of Ti is preferably 0.06° to 2.00%, and more preferably 0.30% to 1.20%.

<Sn: 0.00% to 2.00%>

Sn is an element that particularly enhances heat resistance. From the viewpoint of sufficiently exhibiting such an effect, it is preferable that the content of Sn is adjusted to 0.06% or more. However, when the content of Sn is adjusted to more than 2.00%, workability is deteriorated. Therefore, the content of Sn is preferably 0.00% to 2.00%, more preferably 0.06% to 2.00%, and even more preferably 0.30% to 1.20°. Meanwhile, the content of Sn may be set to 0.00°. Furthermore, when corrosion resistance in the case of being used in a corrosive environment is considered, it is preferable that the aluminum alloy material contains Sn. Furthermore, when the content of Sn is less than 0.06%, the effect of corrosion resistance is insufficient. Furthermore, when the content of Sn is more than 2.00%, workability is deteriorated. Therefore, from the viewpoint of corrosion resistance, the content of Sn is preferably 0.06% to 2.00%, and more preferably 0.30% to 1.20%.

Regarding a mechanism by which each of the element components of Cu, Ag, Zn, Ni, Ti, Co, Au, Mn, Cr, V, Zr, and Sn described above enhances heat resistance, examples include: (I) a mechanism in which since the difference between the atomic radius of the above-described component and the atomic radius of aluminum is large, the energy of crystal grain boundaries is decreased; (II) a mechanism in which since the diffusion coefficient of the above-described component is large, in a case in which the component has penetrated into the grain boundaries, the degree of mobility of the grain boundaries is decreased; and (III) a mechanism in which the interaction between pores is significant, and the diffusion phenomenon is retarded in order to trap pores, and it is speculated that these mechanisms (I) to (III) act synergistically.

<Balance: Al and Unavoidable Impurities>

The balance other than the components mentioned above is Al and unavoidable impurities. The unavoidable impurities mean impurities at a content level that may be unavoidably included in view of the production procedure. Since unavoidable impurities can become a causative factor that decreases the workability depending on the content, it is preferable to suppress the content of the unavoidable impurities to a certain extent by taking a decrease in workability into account. Examples of a component that may be listed as the unavoidable impurities include boron (B), bismuth (Bi), lead (Pb), gallium (Ga), and strontium (Sr). Meanwhile, the upper limit of the contents of these unavoidable impurities may be adjusted to 0.05% or less for each of the above-described components, and to 0.15% or less as the total amount of the above-described components.

Such an aluminum alloy material can be realized by controlling the alloy composition and the production process in combination.

(3) Second Conductor

The second conductor is constructed of a known metal material or alloy material selected from the group consisting of copper, copper alloy, aluminum, and aluminum alloy.

Furthermore, the first conductor and the second conductor may have the same dimension (particularly in the case of a circular cross-section, the same (element wire) diameter) or may have different dimensions, as viewed from a transverse cross-section of the movable cable. For example, in a case in which the flexural fatigue resistance is considered important, it is preferable that the movable cable is formed from conductors having the same dimension. Furthermore, in a case in which reduction of gaps formed between a conductor and a conductor, which constitute a twisted wire conductor (for example, an insulation coated core or a composite twisted wire), and between a conductor and the coating, is considered important; in a case in which twisted wire conductors carrying out electric power transmission and signal transmission are simultaneously included in the same cable; or the like, it is preferable that the movable cable is formed from conductors having different dimensions. Furthermore, the cross-sectional shape of the second conductor is not limited to a circular shape, similarly to the first conductor, and various shapes such as a rectangular shape (plate shape) can be adopted. In addition, the conductor of the movable cable may be constructed using a first conductor formed by combining a plurality of types of conductors (for example, element wires) having different dimensions, or the conductor of the movable cable may be constructed using a second conductor formed by combining a plurality of types of conductors (for example, element wires) having different dimensions, and it is also possible to construct the conductor of the movable cable using both of these first conductor and second conductor in combination.

Meanwhile, in a case in which reduction of resistance of the conductor is considered important, it is preferable that the second conductor is constructed of copper or copper alloy. Specific examples of the copper-based material used as the second conductor include oxygen-free copper, tough pitch copper, phosphorus deoxidized copper, Cu—Ag-based alloys, Cu—Sn-based alloys, Cu—Mg-based alloys, Cu—Cr-based alloys, and Cu—Mg—Zn-based alloys, as well as the copper alloys for conductors as defined in ASTM B105-05. Furthermore, it is also acceptable to use plated wires obtained by plating these copper-based materials with Sn, Ni, Ag, Cu, and the like.

Furthermore, in a case in which weight reduction of a cable is considered important, it is preferable that the second conductor is constructed of aluminum or aluminum alloy. Specific examples of the aluminum-based material used as the second conductor include ECAL, Al—Zr-based alloys, 5000 series alloys, Al—Mg—Cu—Si-based alloys, and 8000 series alloys defined in ASTM B800-05. It is also acceptable to use plated wires obtained by plating these aluminum-based materials with Sn, Ni, Ag, Cu, and the like.

Furthermore, regarding the second conductors, the cable may be constructed using two or more kinds of metal materials, alloy materials having different compositions, or a metal material and an alloy material, which are selected from the group consisting of copper or copper alloy and aluminum or aluminum alloy.

(4) Movable Cable

Next, the configuration of the conductors of the movable cable of the present embodiment and actions thereof will be explained using FIG. 2 to FIG. 13, by taking an elevator cable as an example.

Figure 2:
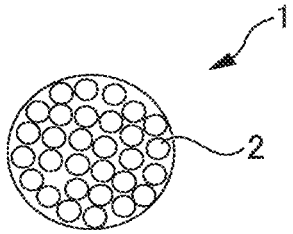
FIG. 2 is a cross-sectional view schematically illustrating a first insulation coated core constituting the movable cable of the present invention.
Figure 3:
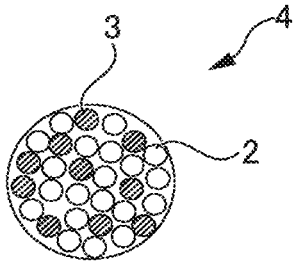
FIG. 3 is a cross-sectional view schematically illustrating a second insulation coated core constituting the movable cable of the present invention.
Figure 4:
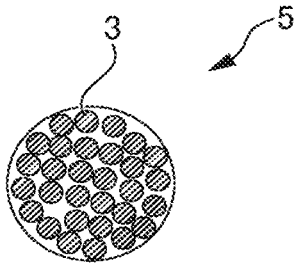
FIG. 4 is a cross-sectional view schematically illustrating a third insulation coated core constituting the movable cable of the present invention.
Figure 5:
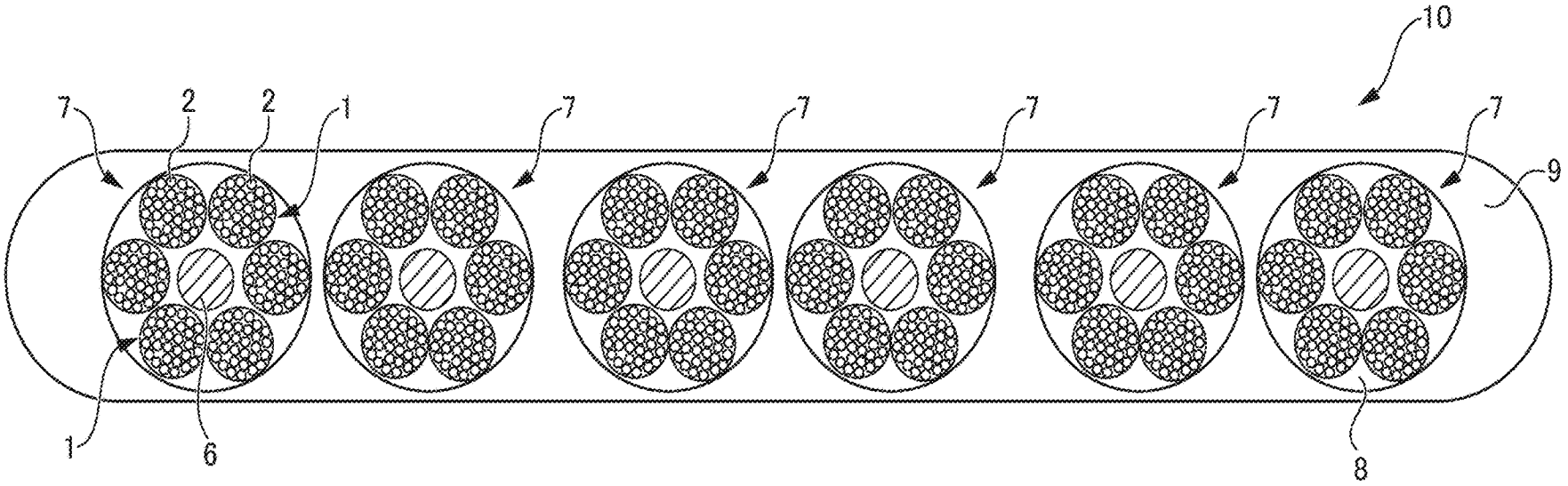
FIG. 5 is a cross-sectional view schematically illustrating a movable cable of a first embodiment.

FIG. 2 shows in an enlarged manner a first insulation coated core 1 that constitutes a movable cable 10 of the first embodiment illustrated in FIG. 5. The movable cable 10 of the present embodiment has a conductor therein. This conductor is configured to include a first conductor 2 formed from the above-mentioned specific aluminum alloy material. The movable cable 10 of the embodiment illustrated in FIG. 5 is a flat cable, and shows a case in which a plurality of composite twisted wires, in FIG. 5, six composite twisted wires 7 that is formed by using a plurality of first insulation coated cores, in FIG. 5, six first insulation coated cores 1 formed by twisting a plurality of first conductors 2 shown in FIG. 2 and insulative coating the resultant, and further twisting these first insulation coated cores 1, is disposed in parallel as conductors inside the movable cable 10. Furthermore, FIG. 5 illustrates a case in which an interposed body 6 is disposed at the central position inside a composite twisted wire 7; however, such an interposed body 6 can be appropriately disposed as necessary, or may not be disposed. Furthermore, in a case in which the cable length is long, and the own weight of the cable cannot be supported by conductors only, it is preferable to dispose, for example, a wire material made of steel such as a wire rope, or a tension member that uses high-tension fibers, and the disposition may be achieved by using any known method.

A main feature in the configuration of the present invention is that the area proportion X occupied by the first conductor 2 in the whole conductor of the movable cable 10 is adjusted to the range of 10% to 100% as viewed from a transverse cross-section of the movable cable 10. By adopting such a configuration, a movable cable that has equal or higher strength compared to conventional movable cables, has excellent flexural fatigue resistance and flexibility, and is lightweight, can be provided. When the area proportion X is less than 10%, not only the weight reduction effect is small, but also sufficient durability (flexural fatigue resistance) is not obtained, and high reliability is not obtained.

Here, the area proportion X (%) occupied by the first conductor 2 in the whole conductor of the movable cable 10 is represented by the following formula by the total cross-sectional area S1 of the first conductor 2 and the total cross-sectional area S of the conductor constituting the movable cable 10 as viewed from a cross-section (transverse cross-section) perpendicular to the longitudinal direction of the movable cable 10:

$$X(\%)=(S1/S)\times 100$$

Figure 6:
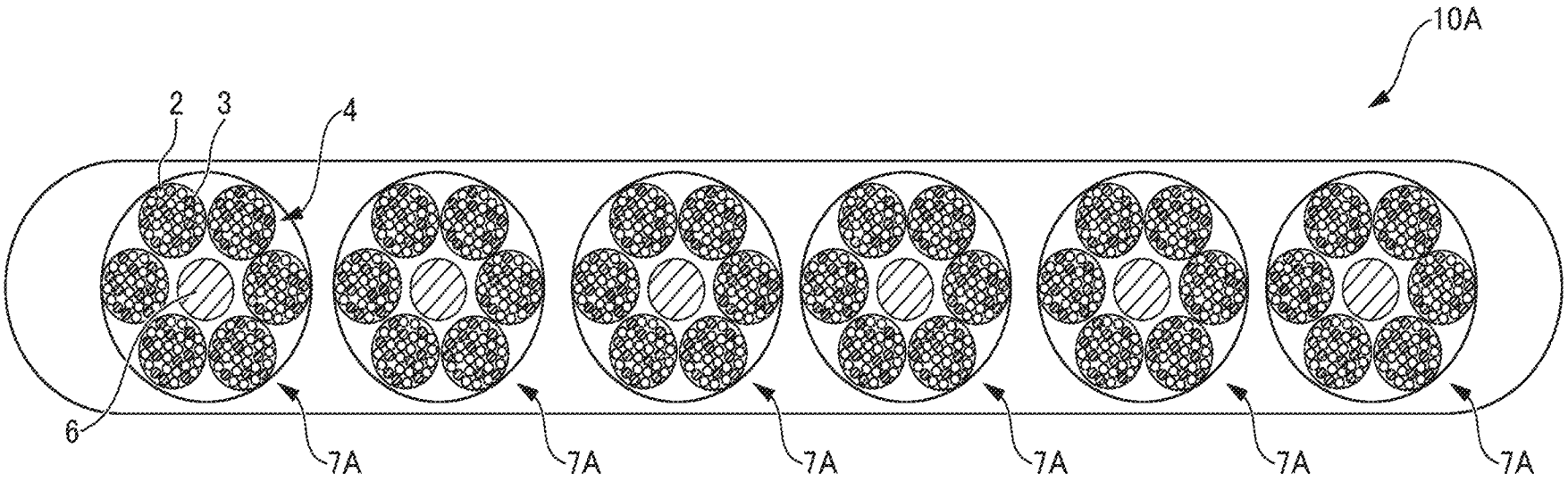
FIG. 6 is a cross-sectional view schematically illustrating a movable cable of a second embodiment.

Furthermore, FIG. 6 illustrates a movable cable 10A of a second embodiment. This movable cable 10A is a flat cable, and shows a case in which the conductor includes a plurality of second insulation coated cores, for example, six second insulation coated cores 4 in FIG. 6 formed by mixing a plurality of first conductors 2 and a plurality of second conductors 3, twisting their conductors 2, 3, and insulative coating their twisted conductors, and a plurality of composite twisted wires, for example, six composite twisted wires 7A in FIG. 6 formed by further twisting these second insulation coated cores 4 is disposed in parallel as conductors inside the movable cable 10A.

Figure 7:
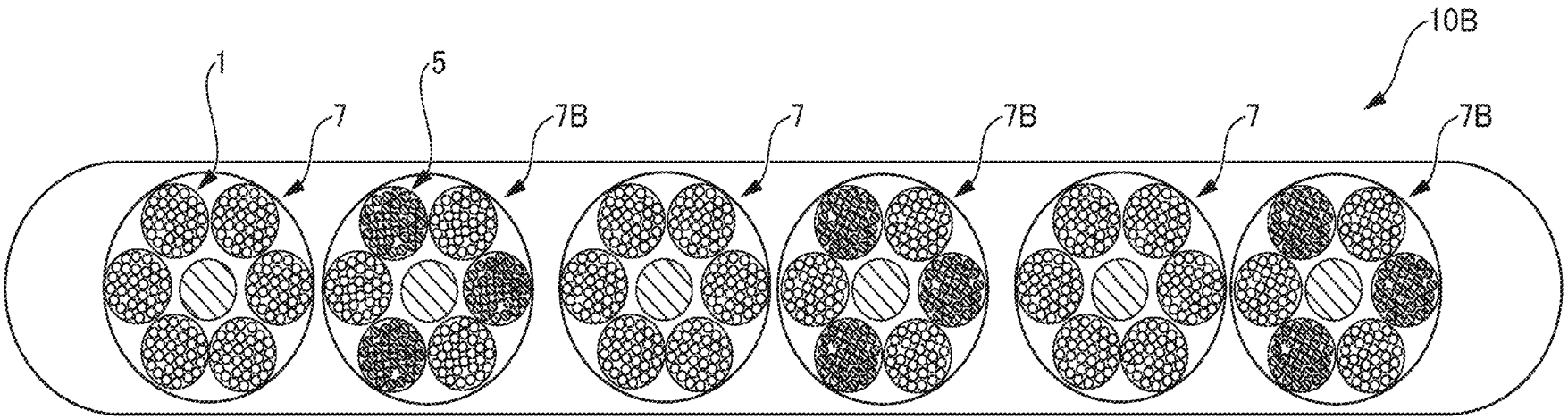
FIG. 7 is a cross-sectional view schematically illustrating a movable cable of a third embodiment.

Moreover, FIG. 7 illustrates a movable cable 10B of a third embodiment. This movable cable 10B is a flat cable, and shows a case in which three composite twisted wires 7 each formed by twisting a plurality of first insulation coated cores, in FIG. 7, six first insulation coated cores 1, which is formed by twisting a plurality of first conductors 2 and insulative coating the resultant; and three composite twisted wires 7B each formed by twisting a plurality of first insulation coated cores, in FIG. 7, three first insulation coated cores 1, and a plurality of third insulation coated cores, in FIG. 7, three third insulation coated cores 5, which is formed by twisting a plurality of second conductors 3 and insulative coating the resultant, are alternately disposed in parallel as conductors inside the movable cable 10B. As such, in the present invention, the conductor may further include third insulation coated cores 5 obtained by twisting together a plurality of second conductors 3 and insulative coating the resultant.

Figure 8:
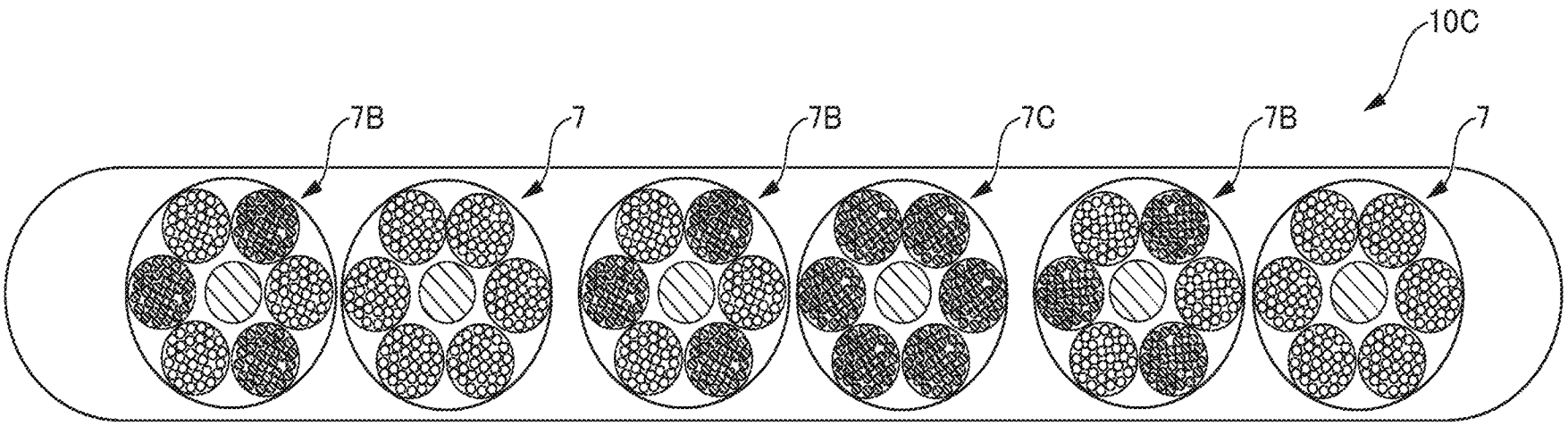
FIG. 8 is a cross-sectional view schematically illustrating a movable cable of a fourth embodiment.

FIG. 8 illustrates a movable cable 10C of a fourth embodiment. This movable cable 10C is a flat cable, and shows a configuration in which two composite twisted wires 7 each composed of six first insulation coated cores 1; three composite twisted wires 7B each formed by twisting three first insulation coated cores 1 and three third insulation coated cores 5; and one composite twisted wire 7C composed of six third insulation coated cores 5 are disposed in combination in parallel.

Figure 9:
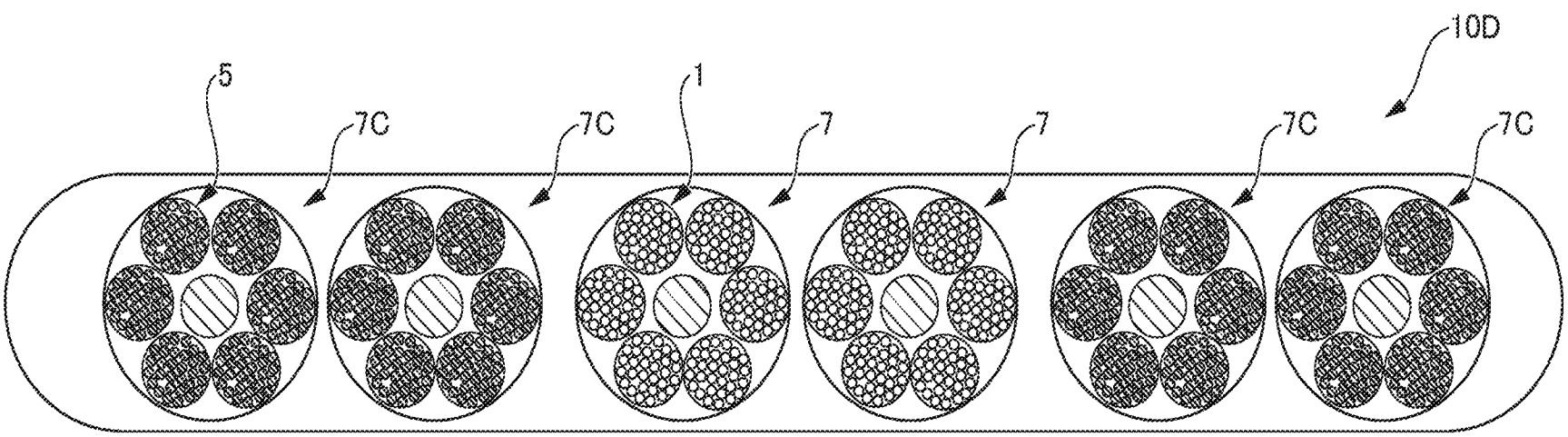
FIG. 9 is a cross-sectional view schematically illustrating a movable cable of a fifth embodiment.

FIG. 9 illustrates a movable cable 10D of a fifth embodiment. This movable cable 10D is a flat cable, and shows a case in which two composite twisted wires 7 each composed of six first insulation coated cores 1; and four composite twisted wires 7C each composed of six third insulation coated cores 5 are disposed in combination in parallel.

Figure 10:
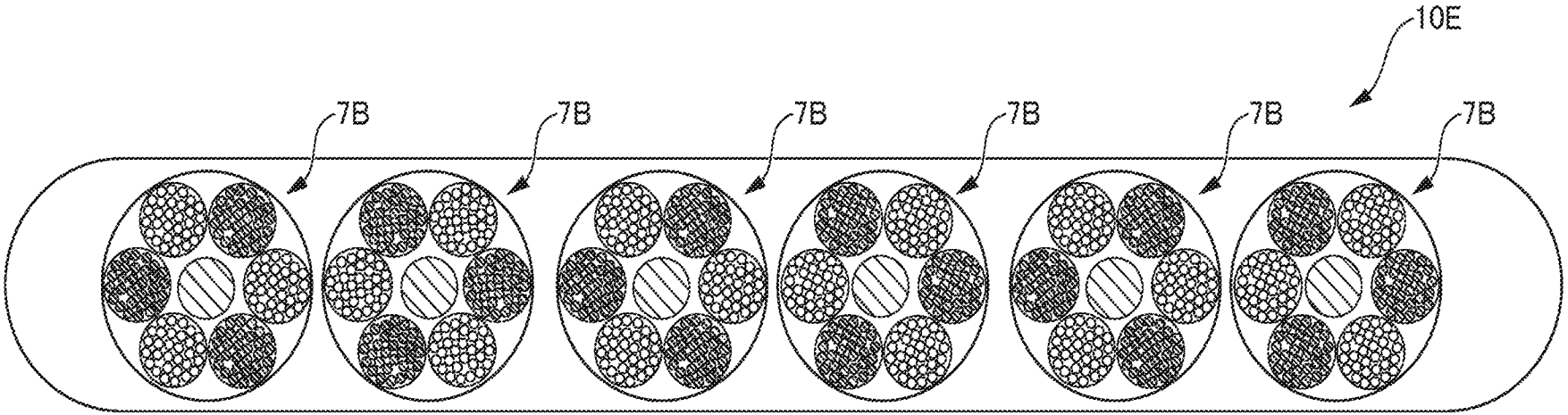
FIG. 10 is a cross-sectional view schematically illustrating a movable cable of a sixth embodiment.

FIG. 10 illustrates a movable cable 10E of a sixth embodiment. This movable cable 10E is a flat cable, and shows a case in which six composite twisted wires 7B each formed by twisting together three first insulation coated cores 1 and three third insulation coated cores 5 are disposed in parallel.

Figure 11:
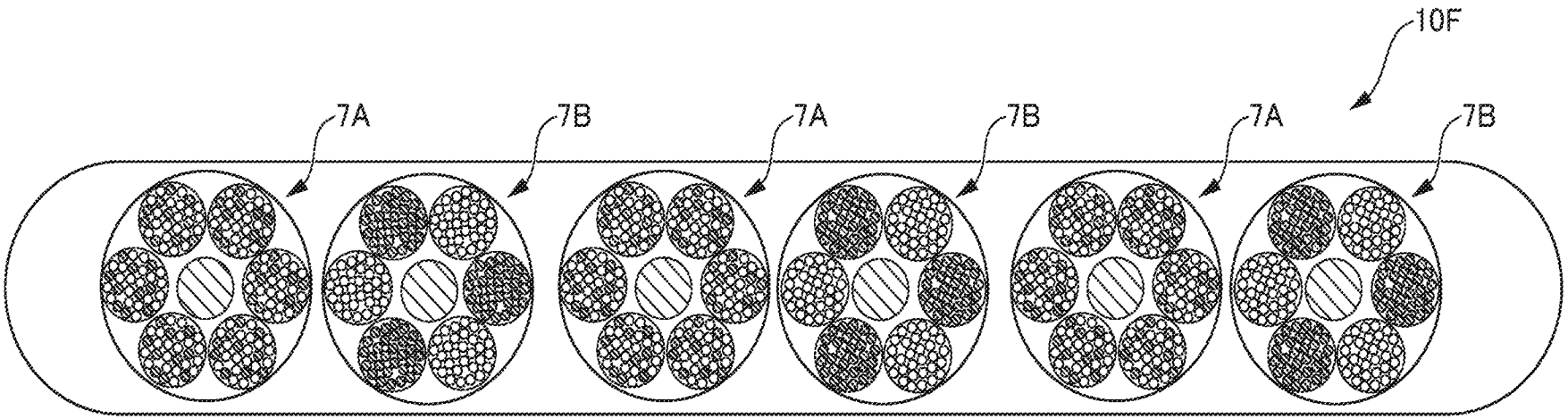
FIG. 11 is a cross-sectional view schematically illustrating a movable cable of a seventh embodiment.

FIG. 11 illustrates a movable cable 10E of a seventh embodiment. This movable cable 10F is a flat cable, and shows a case in which three composite twisted wires 7A each formed by twisting six second insulation coated cores 4; and three composite twisted wires 7B each formed by twisting three first insulation coated cores 1 and three third insulation coated cores 5 are alternately disposed in parallel.

Figure 12:
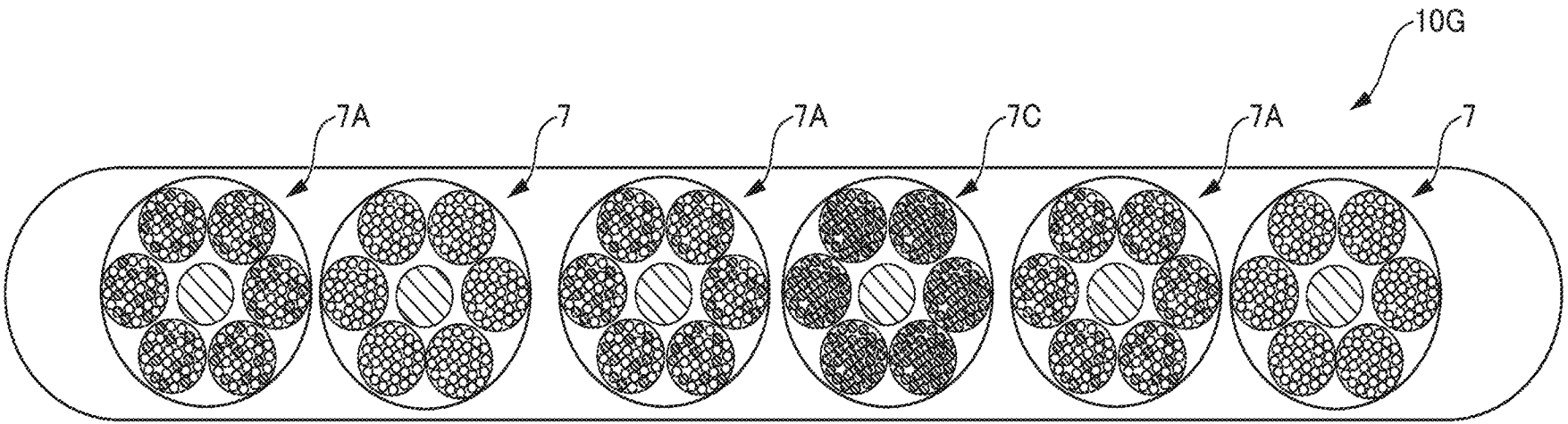
FIG. 12 is a cross-sectional view schematically illustrating a movable cable of an eighth embodiment.

FIG. 12 illustrates a movable cable 10G of an eighth embodiment. This movable cable 10G is a flat cable, and shows a case in which the conductor includes a first insulation coated core 1 obtained by twisting a plurality of first conductors 2 and insulative coating their twisted conductors, and a second insulation coated core 4 obtained by mixing a plurality of first conductors 2 and a plurality of the second conductor 3, twisting their conductors 2, 3, and insulative coating their twisted conductors. More specifically, the movable cable 10G shows a case in which two composite twisted wires 7 each composed of a plurality of first insulation coated cores, in FIG. 12, six first insulation coated cores 1; three composite twisted wires 7A each formed by twisting a plurality of second insulation coated cores, in FIG. 12, six second insulation coated cores 4; and one composite twisted wire 7C composed of a plurality of third insulation coated cores, in FIG. 12, six third insulation coated cores 5 are disposed in combination in parallel.

Figure 13:
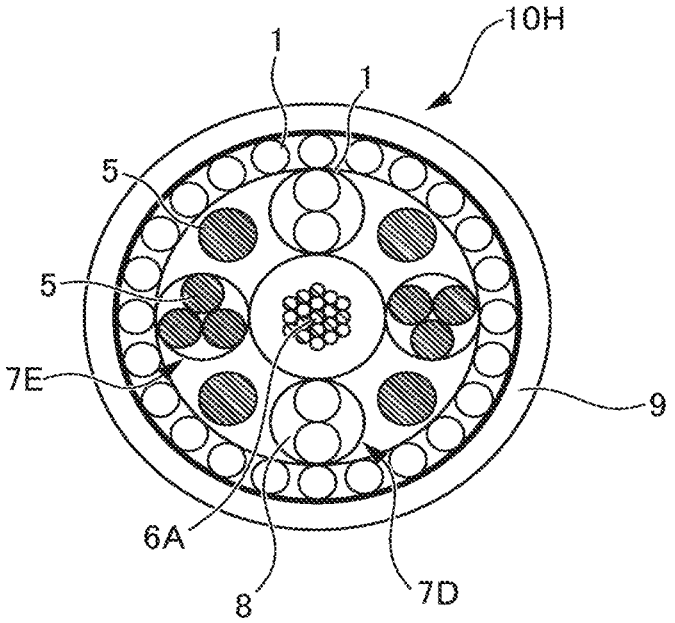
FIG. 13 is a cross-sectional view schematically illustrating a movable cable of a ninth embodiment.

FIG. 13 illustrates a movable cable 10H of a ninth embodiment. This movable cable 10H is a round cable, and shows a case in which two composite twisted wires 7D each formed by twisting two first insulation coated cores 1; two composite twisted wires 7E each formed by twisting three third insulation coated cores 5; and four third insulation coated cores 5 are disposed around a tension member 6A, and twenty-four first insulation coated cores 1 are further disposed on the outer periphery side of these two composite twisted wires 7D, two composite twisted wires 7E, and four third insulation coated cores 5. First to ninth embodiments have been specifically described to this point; however, the present invention is not limited to these embodiments only, and various configurations can be employed.

Furthermore, it is preferable that the movable cable 10 of the present invention is constructed of one or more cables (FIG. 5 to FIG. 13 all represent the cases of a single cable) each comprising: one or more composite twisted wires 7, 7A, 7B, or 7D each which includes at least one insulation coated core of a first insulation coated core 1 and a second insulation coated core 4 among the first insulation coated core 1, the second insulation coated core 4, and the third insulation coated core 5 such that the area proportion X of the first conductor 2 reaches one level or higher, and is formed by twisting their insulation coated cores; and an insulator 8 or a sheath 9 for insulative coating the composite twisted wires 7 so as to include the composite twisted wires 7 as shown in FIG. 5 to FIG. 13.

<Use Applications of Movable Cable>

The movable cable of the present invention can be used for a variety of use applications, and it is particularly suitable to apply the movable cable to use applications where light weight, high strength, and excellent flexural fatigue resistance in particular are required, for example, an elevator cable, a robot cable, and a cabtire cable.

[Method for Producing Movable Cable]

Next, an example of a method for producing a first conductor (specific aluminum alloy material) constituting the movable cable according to the present invention will be described below. The specific aluminum alloy material constituting such a movable cable according to an embodiment of the present invention has a feature that strength increase and fatigue life increase are attempted by introducing crystal grain boundaries at a high density into the interior of, for example, an Al—Mg—Si—Fe-based alloy material or an Al—Cu—Mg—Fe-based alloy material. Particularly, further fatigue life increase can be attempted by accumulating small crystal grains in the vicinity of the surface layer where bending strain becomes large. Therefore, this method is significantly different from a method of precipitating and hardening a Mg—Si compound and a method of solid-solutioning and reinforcing by means of solid-solution elements, which have been generally carried out for conventional aluminum alloy materials, in view of the approach to the increase in strength and the increase in the fatigue life.

In a preferred production method for an aluminum alloy material of the present embodiment, an aluminum alloy material having a predetermined alloy composition is subjected to cold working [1] at the working ratio of 4 or higher as final working. Furthermore, if necessary, a preliminary treatment process [2] of making the crystal grain diameter in the surface layer fine may be carried out before the cold working [1], and temper annealing [3] may be carried out after the cold working [1]. This will be described in detail below.

Usually, when repeated stress is applied to a metal material, crystal slip occurs together with elastic deformation as an elementary process of deformation of metal crystals. Since the metal material, in which such crystal slip easily occurs, has lower strength and crack generation points are produced at the material surface, it can be said that the metal material is liable to undergo fatigue fracture. Therefore, in regard to strength increase and fatigue life increase of a metal material, it is important to suppress crystal slip occurring within the metal structure. As an inhibitory factor for such crystal slip, the presence of crystal grain boundaries within the metal structure may be mentioned. Such crystal grain boundaries can suppress propagation of crystal slip within the metal structure when stress is applied to the metal material, and as a result, the strength and fatigue life of the metal material can be increased.

Therefore, for strength increase and fatigue life increase of a metal material, it is considered desirable to introduce crystal grain boundaries into the metal structure at a high density, that is, to accumulate small crystal grains. Here, regarding the mechanism for forming crystal grain boundaries, for example, splitting of metal crystals concomitant to deformation of the metal structure as follows may be considered.

Usually, the interior of a polycrystalline material is in a complicated multiaxial state in terms of the stress state, due to the difference in the orientation between adjacent crystal grains or to the spatial distribution of strain between the vicinity of the surface layer that is in contact with working tools and the bulk interior. Under the influence of these, crystal grains that are in a single orientation prior to deformation undergo splitting into a plurality of orientations concomitantly with deformation, and orientation difference boundaries are formed between the split crystals.

However, the orientation difference boundaries thus formed are structures different from the conventional closest packed atomic arrangement of twelve coordinates and have interfacial energy. Accordingly, it is speculated that in a conventional metal structure, when the crystal grain boundaries have a certain level of density or higher, the increased internal energy serves as the driving force, and dynamic or static recovery and recrystallization occurs. Therefore, usually, even if the amount of deformation is increased, increase and decrease of the crystal grain boundaries occur simultaneously, and therefore, it is speculated that the grain boundary density reaches a saturated state.

Such a phenomenon also coincides with the relationship between the working ratio and the tensile strength in pure aluminum or pure copper, which are conventional metal structures. In pure aluminum or pure copper, which are conventional metal structures, an increase in the tensile strength (hardening) is observed at a relatively low working ratio; however, as the working ratio increases, the amount of hardening tends to be saturated, and the working ratio at a certain level or higher does not contribute to the increase in strength. Here, it is thought that the working ratio corresponds to the amount of deformation applied to the above-mentioned metal structure, and the saturation of the amount of hardening corresponds to the saturation of the grain boundary density.

Furthermore, when the material is simply subjected to working, strength and the fatigue life increase, while there is a problem that ductility keeps decreasing, and breaking of wire easily occurs at the time of working or at the time of use. This is speculated to be because since displacement is introduced into the crystals in large quantities, the displacement density is saturated, and plastic deformation to a larger extent cannot be tolerated.

In contrast, in the specific aluminum alloy material of the present embodiment, it is found that with an increase in the working ratio, the crystal grain boundary density at the surface layer increases, that is, accumulation of small crystal grains is continued, and the flexural fatigue resistance is continuously enhanced. This is speculated to be because since the specific aluminum alloy material has the above-described alloy composition, an increase in the crystal grain boundary density is promoted, and even if the crystal grain boundaries are present at a density of a certain level or higher in the metal structure, an increase in the internal energy can be suppressed. As a result, it is speculated that recovery and recrystallization in the metal structure can be prevented, and crystal grain boundaries can be effectively increased in the metal structure.

The mechanism for such crystal refinement brought by compound addition of Mg and Si or Mg and Cu is not necessarily clearly understood; however, it is speculated that the mechanism is based on the following: (i) as Mg having a strong interaction with lattice defects called displacements promotes crystal refinement, crystal splitting is promoted; and (ii) as Mg atoms having a large atomic radius and Si atoms having a small atomic radius or Cu mitigate the mismatch against Al atoms in the atomic arrangement at the grain boundaries, an increase in the internal energy concomitant to working can be effectively suppressed.

Furthermore, in the aluminum alloy material of the present embodiment, particularly, since plastic strain is introduced into the surface of the aluminum alloy material, very fine crystals are present in the vicinity of the surface layer, while relatively large crystals remain at the central position. By having such a crystal structure, the fine crystals in the surface layer work effectively at the time of torsion or bending deformation, and the large crystals at the central position work effectively during elongation. Thus, breaking of wire does not easily occur during production.

In the method for producing an aluminum alloy material of the present embodiment, the working ratio for the cold working [1] is adjusted to 4 or higher. Particularly, by performing working based on a high working ratio, splitting of metal crystals concomitant to deformation of the metal structure can be accelerated, and crystal grain boundaries can be introduced at a high density into the interior of the aluminum alloy material. As a result, small crystal grains accumulate in the surface layer of the aluminum alloy material, and flexural fatigue resistance is enhanced to a large extent. Such a working ratio is preferably 6 or higher, and more preferably 8 or higher. Furthermore, the upper limit of the working ratio is not particularly defined; however, the working ratio is usually 15 or lower.

Meanwhile, when the cross-sectional area of the specific aluminum alloy material before working is designated as s1, and the cross-sectional area of the specific aluminum alloy material after working is designated as s2 (s1>s2), the working ratio η is represented by the following Formula (1):

$$\text{Working ratio(dimensionless)}:\eta=\ln(s1/s2) \quad (1)$$

Furthermore, the method for cold working [1] may be appropriately selected according to the intended shape (a wire rod material, a plate material, a strip, a foil, or the like) of the aluminum alloy material, and examples include cassette roller die, grooved roll rolling, round wire rolling, drawing by means of a die or the like, and swaging. Furthermore, the general conditions for working such as described above (type of the lubricant oil, working rate, heat generation for working, and the like) may be appropriately adjusted to known ranges.

Furthermore, a preliminary treatment process [2] may be carried out before the cold working [1]. With regard to the preliminary treatment process [2], shot peening, extrusion, swaging, skin pass, rolling, and recrystallization. Thereby, a gradient can be applied to the crystal grain diameter between the surface layer and the interior of the aluminum alloy material in the previous step of cold working [1], and the crystal structure after the cold working [1] can be made finer, while the gradient of the crystal grain diameter can be made larger. Regarding the general conditions for the above-described process (working rate, heat generation for working, temperature, and the like), firing may be appropriately carried out in known ranges. Meanwhile, in the present invention, an aging precipitation heat treatment is not carried out before cold working. It is because when an aging precipitation treatment is carried out before cold working, breaking of wire occurs as a result of: (a) deformation being concentrated in particular spaces within crystal grains; (b) grain boundaries being split from grain boundary precipitates as starting points.

Furthermore, the aluminum alloy material is not particularly limited as long as it has the above-described alloy composition, and for example, an extruded material, a cast ingot material, a hot rolled material, and a cold rolled material can be appropriately selected and used according to the purpose of use.

Furthermore, for the purpose of relaxing residual stress and enhancing elongation, temper annealing [3] may be carried out after the cold working [1]. The treatment temperature of the temper annealing [3] is set to 50° C. to 180° C. In a case in which the treatment temperature of the temper annealing [3] is below 50° C., it is difficult to obtain effects such as described above, and in a case in which the treatment temperature is above 180° C., growth of crystal grains occur as a result of recovery and recrystallization, and strength and fatigue life are decreased. Furthermore, the retention time for the temper annealing [3] is preferably 1 to 48 hours. Meanwhile, the general conditions for such a heat treatment can be appropriately regulated by means of the type and amount of unavoidable impurities, and the solid-solution and precipitation state of the aluminum alloy material.

Meanwhile, an intermediate heat treatment in conventional production methods is intended to lower the deformation resistance by recrystallizing the metal material, and to thereby reduce the load of working machines or reduce abrasion of tools that come into contact with the material, such as a die and a capstan; however, in such an intermediate heat treatment, fine crystal grains as in the case of the specific aluminum alloy material constituting the twisted wire conductor of the present invention are not obtained.

Furthermore, as explained above, for the aluminum alloy material of the embodiment, it is effective to have a high working ratio for the refinement of crystal grains of the surface layer of the aluminum alloy material. Therefore, it is easier to realize the configuration of the aluminum ally material of the present embodiment, as the diameter is made finer in the case of producing a wire material, and as the thickness is made thinner in the case of producing a plate material or a foil.

Particularly, in a case in which the aluminum alloy material is a wire material, the wire diameter is preferably 1.0 mm or less, more preferably 0.5 mm or less, even more preferably 0.30 mm or less, and particularly preferably 0.10 mm or less. Meanwhile, the lower limit of the wire diameter is not particularly set up; however, in consideration of workability or the like, it is preferable that the lower limit is 0.01 mm.

Furthermore, in a case in which the aluminum alloy material is a plate material, the plate thickness is preferably 2.00 mm or less, more preferably 1.50 mm or less, even more preferably 1.00 mm or less, and particularly preferably 0.50 mm or less. Meanwhile, the lower limit of the plate thickness is not particularly set up; however, in consideration of workability or the like, it is preferable that the lower limit is 0.02 mm.

Furthermore, as explained above, the aluminum alloy material is worked into a fine or thin product; however, it is also possible to prepare a plurality of such aluminum alloy materials, join these into a thick product, and then use the product for an intended use application. Meanwhile, regarding the method for joining, any known method can be used, and examples include pressure welding, welding, joining with an adhesive, and friction stir joining.

Next, a first insulation coated core 1 and a second insulation coated core 4 are produced by using a first conductor (specific aluminum alloy material) and a second conductor produced by the above-described procedures and twisting the respective conductors together as described above, and if necessary, a third insulation coated core 5 is produced. Various composite twisted wires (units) 7, 7A, 7B, 7C, 7D, and 7E formed using at least one of these first insulation coated core 1 and second insulation coated core 4 (and if necessary, the third insulation coated core 5) are insulative coated with an insulator or a sheath, in a state in which the composite twisted wires (units) 7, 7A, 7B, 7C, 7D, and 7E are disposed as conductors positioned inside, and thereby the movable cables of the present invention can be produced. Regarding the method of twisting together a plurality of conductors, or the method of twisting together a plurality of insulation coated cores, any known method of twisting together can be used. Meanwhile, the temper annealing [3] may be carried out after the specific aluminum alloy material that has been subjected to the cold working [1] described above is subjected to working by joining or twisting together.

According to the embodiments described above, the first conductor (specific aluminum alloy material) produced according to the production method described above has a predetermined alloy composition and also has a fiber-like metal structure in which crystal grains extend to be aligned in one direction, and the average value of the crystal grain diameter in a cross-section perpendicular to the one direction is 400 nm or less. Therefore, the specific aluminum alloy material exhibits strength and a fatigue life that significantly exceed the flexural fatigue resistance of conventional aluminum alloy material and are comparable to that of copper-based metal materials, and therefore, a movable cable having the conductor constructed using this first conductor can exhibit high strength and excellent fatigue characteristics with a light weight.

Thus, embodiments have been described; however, the present invention is not limited to the embodiments described above and includes all aspects included in the concept and claims of the present invention, and various modifications can be made within the scope of the present invention.

EXAMPLES

Next, Examples and Comparative Examples will be described; however, the present invention is not intended to be limited to these Examples.

Examples 1 to 28

Using a wire material or a rod material having the alloy composition indicated in Table 1, skin pass working was performed as a preliminary treatment process [2] using a wire drawing die such that the one-pass area reduction ratio would be less than 5°, and then under the production conditions indicated in Table 1, a first conductor formed from a specific aluminum alloy material and having a wire diameter of 0.1 mm was produced. Thus, a cable was produced to have the configuration indicated in Table 1.

Comparative Examples 1 to 7

Using a wire material or a rod material having the alloy composition indicated in Table 1-2 and under the production conditions indicated in Table 1-2, a (first) conductor formed from an aluminum alloy material was produced, and a cable was produced to have the configuration indicated in Table 1-2.

Meanwhile, production conditions A to F indicated in Table 1-2 were specifically as follows.

<Production Conditions A>

A prepared rod material was subjected to cold working [1] at working ratio of 6.0. Meanwhile, temper annealing [3] was not carried out.

<Production Conditions B>

Production was carried out under the same conditions as production conditions A, except that the working ratio of cold working [1] was adjusted to 8.5.

<Production Conditions C>

Production was carried out under the same conditions as production conditions A, except that the working ratio of cold working [1] was adjusted to 10.5.

<Production Conditions D>

A prepared rod material was subjected to cold working [1] at the working ratio of 8.5, and then temper annealing [3] was carried out under the conditions of a treatment temperature of 140° C. and a retention time of 5 hours.

<Production Conditions E>

Production was carried out under the same conditions as production conditions A, except that the working ratio of cold wire drawing [1] was adjusted to 3.5.

<Production Conditions F>

A prepared rod material was subjected to an aging precipitation heat treatment at a treatment temperature of 180° C. for a retention time of 10 hours, and then was subjected to cold working [1]; however, since breaking of wire occurred many times, the operation was stopped.

Conventional Example 1

In Conventional Example 1, a second conductor formed form a soft material of a pure copper material (tough pitch copper, TPC) was produced, without using a first conductor formed from a specific aluminum alloy material.

Conventional Example 2

In Conventional Example 2, a second conductor formed from a hard material of a pure aluminum material (ECAL) was produced, without using a particular aluminum alloy material.

Comparative Example 8

<Production Conditions G>

Into a graphite crucible, aluminum having a purity of 99.95%, magnesium having a purity of 99.95%, silicon having a purity of 99.99%, and iron having a purity of 99.95% were introduced respectively at a predetermined amount, the metals were stirred and melted at 720° C. by high frequency induction heating, and thereby a molten metal having an alloy composition of Al—0.60% by mass of Mg—0.30% by mass of Si—0.05% by mass of Fe was produced. Subsequently, this molten metal was transferred into a vessel provided with a graphite die, and a wire having a diameter of 10 mmϕ and a length of 100 mm was continuously cast through the water-cooled graphite die at a casting rate of about 300 mm/min. Then, a cumulative equivalent strain of 4.0 was introduced according to an ECAP method. The recrystallization temperature in this stage was determined to be 300° C. Then, preliminary heating for 2 hours at 250° C. was carried out in an inert gas atmosphere.

Next, a first wire drawing treatment at a working ratio of 0.34 was applied. The recrystallization temperature in this stage was determined to be 300° C. Then, a primary heat treatment for 2 hours at 260° C. was carried out in an inert gas atmosphere. Subsequently, the resultant was passed through a water-cooled wire drawing die at a drawing rate of 500 ram/min, and a second wire drawing treatment at the working ratio of 9.3 was carried out. The recrystallization temperature in this stage was determined to be 280° C. Then, a secondary heat treatment for one hour at 220° C. was carried out in an inert gas atmosphere, and an aluminum alloy wire material having a wire diameter of 0.08 mm was obtained.

[Evaluation]

The various first conductors (specific aluminum alloy materials) obtained in the Examples described above and the various conductors obtained in the Comparative Examples described above were used, and using each of these conductors, as shown in FIG. 5, six first insulation coated cores 1 were each formed by twisting together the same conductors (in the Examples, the first conductor) having a twist structure of 30 (number of conductors)/0.18 (element wire diameter) and insulative coating the resultant, six composite twisted wires were each formed by further twisting together the six first insulation coated cores 1, the six composite twisted wires were disposed in parallel as conductors, these composite twisted wires (unit) were insulative coated with an insulator and a sheath in a state of being disposed in parallel, and thereby a flat movable cable was produced. For all of the cables, the insulating materials of the insulator and the sheath were made of vinyl chloride, the weight of the insulating material was 588 g/m, and tension members were appropriately disposed based on the Examples. Using each of the movable cables thus produced, characteristic evaluations as described below were carried out.

[1] Alloy Composition of Specific Aluminum Alloy Material

The analysis was carried out by an emission spectral analysis method according to JIS H1305:2005. Meanwhile, the measurement was carried out using an emission spectral analyzer (manufactured by Hitachi High-Tech Science Corporation).

[2] Observation of Structure of Specific Aluminum Alloy Material

Observation of the metal structure was carried out by scanning ion microscope (SIM) observation using a scanning ion microscope (SMI3050 TB, manufactured by Seiko Instruments, Inc.). The observation was carried out at an accelerating voltage of 30 kV.

Regarding a sample for observation, a sample obtained by cutting the above-described aluminum alloy wire material at a cross-section parallel to the longitudinal direction (direction of working) of the aluminum alloy wire material and at a cross-section perpendicular to the longitudinal direction, to a thickness of 100 nm±20 nm by means of focused ion beam (FIB), and finishing the resultant by ion milling, was used.

In the SIM observation, grey contrast was used, the difference in contrast was considered as the orientation of crystals, and thereby, boundaries at which the contrast discontinuously changed were recognized as crystal grain boundaries. Meanwhile, there are occasions in which, depending on the diffraction conditions for the electron beam, there is no difference in the grey contrast even if there is a difference in the crystal orientation. In that case, the angle between the electron beam and the sample was changed by inclining the angle at ±3° each time by means of two axes of sample rotation orthogonally intersecting each other in a sample stage of the electron microscope, an image of the observation surface was captured under a plurality of diffraction conditions, and grain boundaries were recognized. Furthermore, the visual field for observation was set to (15 to 40) μm×(15 to 40) μm, and observation was performed at a position in the vicinity between the center and the surface area (a position on the central side only by about ¼ of the wire diameter from the surface layer side) on a line corresponding to the wire diameter direction (direction perpendicular to the longitudinal direction) in the cross-sections parallel and perpendicular to the direction of working. The visual field for observation was adjusted as appropriate according to the size of the crystal grains.

Then, from an image captured at the time of performing the SIM observation, the presence or absence of a fiber-like metal structure in a cross-section parallel to the longitudinal direction (direction of working) of the aluminum alloy wire material was determined. In a case in which a fiber-like metal structure was observed, the fiber-like metal structure was evaluated to be "Present".

Furthermore, in each visual field of observation, any arbitrary one hundred crystal grains were selected, the minor axis of crystal at a cross-section perpendicular to the longitudinal direction of each of the crystal grains, and the major axis of crystal at a cross-section parallel to the longitudinal direction of the crystal grain were measured, and the aspect ratio of that crystal grain was calculated. Furthermore, for the dimension perpendicular to the longitudinal direction of a crystal grain and the aspect ratio, the average values were calculated from the total number of observed crystal grains. Meanwhile, in some of the Comparative Examples, since the average crystal grain diameter R1 was obviously larger than 400 nm, crystal grains larger than 400 nm were not selected and were excluded from the object of measurement, and the respective average values were calculated. Furthermore, for crystal grains obviously having an aspect ratio L1/L2 of 10 or higher, the aspect ratio L1/L2 was uniformly considered as 10 or higher.

[3] Flexural Fatigue Resistance

Regarding the flexural fatigue resistance, each of the movable cables was subjected to a repeated bending test according to JIS C 3005:2014. Regarding the test conditions, the test was carried out under two kinds of conditions, that is, a case in which the fixed distance l was set to 300 mm and the bend radius r was set to 60 mm, and a case in which the bend radius r was set to 30 mm, and the number of repeated bending was set to 1,000,000 times. For each of the movable cables after the test, the number of conductors (element wires) that had the insulating coating torn off and were broken was counted, the proportion (%) of the number of broken conductors (element wires) with respect to the total number of the conductors was calculated, and the flexural fatigue resistance was evaluated from this calculated value. The flexural fatigue resistance is presented in Tables 1-1 and 1-2. Meanwhile, as the value of the flexural fatigue resistance in Tables 1-1 and 1-2 is smaller, it means that the flexural fatigue resistance is superior.

[4] Cable Weight

Regarding the cable weight, the cable was cut into a length of 1 m, the weight of the cut cable (insulating material and conductor) having a length of 1 m was measured, and this value of weight thus measured was converted to a value of weight per kilometer of the wire length. In the present Examples, Conventional Example 1 in which a movable cable was produced using a second conductor formed from a pure copper material (tough pitch copper, TPC) was regarded as the reference (833 kg/km), and for the value of weight per kilometer of the wire length, a case that was less than this value of reference was considered as an acceptable level.

[5] Number of Required Tension Members

For each of the movable cables, the number of tension members made of steel required for supporting a 300-m cable was calculated by taking the cable weight, and the elastic modulus and strength of each conductor into account, and this number of the required tension members thus calculated was determined as a value converted as the index proportion (%) when the case of Conventional Example 1 in which the conductor was all made of a pure copper material was designated as 100 (reference). These evaluation results are presented in Tables 1-1 and 1-2. Meanwhile, as the value converted from the number of required tension members as presented in Tables 1-1 and 1-2 is smaller, it is more desirable because the number of tension members required for supporting a 300-m cable can be reduced, and it means that the cable conductor has high strength and a light weight.

TABLE 1 1

| | | Alloy composition [Mass %] | | | | | | | | | | | Structure evaluation | | | Configuration of conductor constituting cable | | Performance evaluation for cable | | | |
|---|---|---|---|---|---|---|---|---|---|---|---|---|---|---|---|---|---|---|---|---|---|
| | | | | | One or more elements selected from Cu Ag, Zo, Ni, Co, Au, Mn, Cr, V, Gr, Ti, and Sn | | | | | | Al and un-avoidable | Production | Presence or absence of fiberlike metal | Average value of dimension perpendicular to longitudinal direction of | Aspect ratio | Area proportion of specific aluminum alloy material | Balance of | Flexural fatigue resistance (%) Bend radius r | | Weight of cable | Index proportion of number of required tension members |
| | | Mg | S1 | Fe | 1 | | 2 | | 3 | | total | impurities | conditions | structure | crystal grain | (L1/L2) | (%) | conductor | 60 mm | 30 mm | (kg/km) | (%) |
| Example | 1 | 0.50 | 0.60 | 0.22 | — | — | — | — | — | — | 0.00 | Balance | A | Present | 230 nm | ≥10 | 10 | TPC | 0 | 0 | 916 | 90 |
| | 2 | 0.50 | 0.60 | 0.22 | — | — | — | — | — | — | 0.00 | Balance | A | Present | 230 nm | ≥10 | 50 | TPC | 0 | 0 | 748 | 91 |
| | 3 | 0.50 | 0.60 | 0.22 | — | — | — | — | — | — | 0.00 | Balance | A | Present | 230 nm | ≥10 | 100 | — | 0 | 0 | 663 | 7 |
| | 4 | 0.50 | 0.60 | 0.22 | — | — | — | — | — | — | 0.00 | Balance | B | Present | 150 nm | ≥10 | 10 | TPC | 0 | 0 | 916 | 90 |
| | 5 | 0.50 | 0.60 | 0.22 | — | — | — | — | — | — | 0.00 | Balanoe | B | Present | 150 nm | ≥10 | 100 | — | 0 | 0 | 663 | 3 |
| | 6 | 0.50 | 0.60 | 0.22 | — | — | — | — | — | — | 0.00 | Balance | C | Present | 110 nm | ≥10 | 10 | TPC | 0 | 5 | 816 | 90 |
| | 7 | 0.50 | 0.60 | 0.22 | — | — | — | — | — | — | 0.00 | Balance | C | Present | 110 nm | ≥10 | 100 | — | 0 | 0 | 663 | 1 |
| | 8 | 0.50 | 0.60 | 0.22 | — | — | — | — | — | — | 0.00 | Balance | D | Present | 140 nm | ≥10 | 10 | TPC | 0 | 0 | 816 | 90 |
| | 9 | 0.50 | 0.60 | 0.22 | — | — | — | — | — | — | 0.00 | Balance | D | Present | 140 nm | ≥10 | 100 | — | 0 | 0 | 663 | 2 |
| | 10 | 0.50 | 0.60 | 0.35 | — | — | — | — | — | — | 0.00 | Balance | D | Present | 140 nm | ≥10 | 10 | ECAL | 0 | 10 | 663 | 80 |
| | 11 | 0.50 | 0.60 | 0.35 | — | — | — | — | — | — | 0.00 | Balance | D | Present | 140 nm | ≥10 | 50 | ECAL | 0 | 5 | 663 | 70 |
| | 12 | 0.52 | 0.55 | 0.32 | — | — | — | — | — | — | 0.00 | Balance | D | Present | 110 nm | ≥10 | 10 | ECAL | 0 | 10 | 663 | 80 |
| | 13 | 0.52 | 0.55 | 0.32 | — | — | — | — | — | — | 0.22 | Balance | D | Present | 110 nm | ≥10 | 50 | ECAL | 0 | 0 | 663 | 70 |
| | 14 | 0.10 | 0.04 | 0.18 | Cu | 0.22 | — | — | — | — | 0.22 | Balance | D | Present | 320 nm | ≥10 | 10 | TPC | 0 | 5 | 816 | 90 |
| | 15 | 0.10 | 0.04 | 0.18 | Cu | 0.22 | — | — | — | — | 0.22 | Balance | D | Present | 320 nm | ≥10 | 100 | — | 0 | 0 | 663 | 5 |
| | 16 | 0.10 | 0.04 | 0.18 | Cu | 0.22 | — | — | — | — | 0.22 | Balance | D | Present | 320 nm | ≥10 | 10 | ECAL | 0 | 10 | 663 | 80 |
| | 17 | 0.10 | 0.04 | 0.18 | Cu | 0.22 | — | — | — | — | 0.22 | Balance | D | Present | 320 nm | ≥10 | 50 | ECAL | 0 | 5 | 663 | 70 |
| | 18 | 0.06 | 0.21 | 0.33 | — | — | — | — | — | — | 0.00 | Balance | D | Present | 370 nm | ≥10 | 10 | TPC | 0 | 5 | 816 | 90 |
| | 19 | 0.06 | 0.21 | 0.33 | — | — | — | — | — | — | 0.00 | Balance | D | Present | 370 nm | ≥10 | 100 | — | 0 | 0 | 663 | 10 |
| | 20 | 0.52 | 0.48 | 0.19 | Ni | 0.05 | Cr | 0.05 | Ag | 0.21 | 0.31 | Balance | D | Present | 150 nm | ≥10 | 50 | TPC | 0 | 0 | 748 | 90 |
| | 21 | 0.52 | 0.48 | 0.19 | Mn | 0.05 | Au | 0.05 | Ti | 0.01 | 0.11 | Balance | D | Present | 150 nm | ≥10 | 50 | TPC | 0 | 0 | 748 | 90 |
| | 22 | 0.52 | 0.48 | 0.19 | Mn | 0.05 | Ag | 0.21 | — | | 0.26 | Balance | D | Present | 150 nm | ≥10 | 50 | TPC | 0 | 0 | 748 | 90 |
| | 23 | 0.52 | 0.48 | 0.19 | Zr | 0.05 | V | 0.05 | Co | 0.21 | 0.31 | Balance | D | Present | 150 nm | ≥10 | 50 | TPC | 0 | 0 | 748 | 90 |
| | 24 | 0.52 | 0.48 | 0.19 | Mn | 0.05 | Zn | 0.01 | — | — | 0.06 | Balance | B | Present | 150 nm | ≥10 | 50 | TPC | 0 | 0 | 740 | 90 |
| | 25 | 0.29 | 0.29 | 0.19 | — | — | — | — | — | — | 0.00 | Balance | D | Present | 270 nm | ≥10 | 50 | TPC | 0 | 0 | 740 | 90 |
| | 26 | 0.98 | 0.53 | 0.02 | Cu | 0.28 | Cr | 0.17 | — | — | 0.45 | Balance | B | Present | 90 nm | ≥10 | 100 | — | 0 | 0 | 663 | 0 |
| | 27 | 1.80 | 1.70 | 0.30 | — | — | — | — | — | — | 0.00 | Balance | D | Present | 100 nm | ≥10 | 100 | — | 0 | 0 | 663 | 1 |
| | 28 | 0.83 | 0.66 | 1.00 | Ag | 0.05 | Cu | 0.10 | — | — | 0.15 | Balance | A | Present | 250 nm | ≥10 | 10 | TPC | 0 | 5 | 916 | 98 |

TABLE 1-2

| | | Alloy composition [Mass %] | | | | | | | | | | | | Structure evaluation | | | configuration of conductor constituting cable | | Performance evaluation for cable | | | |
|---|---|---|---|---|---|---|---|---|---|---|---|---|---|---|---|---|---|---|---|---|---|---|
| | | | | | One or more elements selected from Cu Ag, Zn, Ni, Co, Au, Mn, Cr, V, Zr, Ti, and Sn | | | | | | | | | | | | Area proportion of specific aluminum alloy material | | Flexural fatigue resistance (%) | | | Index proportion of number of required tension members |
| | | Mg | Si | Fe | 1 | | 2 | | 3 | | total | Al and unavoidable impurities | Production conditions | Presence or absence of fiberlike metal structure | Average value of dimension perpendicular to longitudinal direction of crystal grain | Aspect ratio (L1/L2) | | Balance of conductor | Bend radius r 60 mm | Bend radius r 30 mm | Weight of cable (kg/km) | |
| Comparative example | 1 | 1.80 | 1.70 | 1.70 | — | — | — | — | — | — | 0.00 | Balance | A | | | | Multiple occurrance of wire breaking | | | | | |
| | 2 | 2.30 | 2.50 | 0.40 | Ni | 0.20 | — | — | — | — | 0.20 | Balance | A | | | | Multiple occurrance of wire breaking | | | | | |
| | 3 | 0.50 | 0.60 | 0.22 | Cu | 1.85 | Cr | 0.35 | — | — | 2.20 | Balance | A | | | | Multiple occurrance of wire breaking | | | | | |
| | 4 | 0.50 | 0.60 | 0.22 | — | — | — | — | — | — | 0.00 | Balance | E | Present | 510 nm | ≥10 | 50 | TPC | 40 | 70 | 748 | 90 |
| | 5 | 0.54 | 0.58 | 0.00 | — | — | — | — | — | — | 0.00 | Balance | D | Absent | 470 nm | 7 | 50 | TPC | 30 | 80 | 748 | 90 |
| | 6 | 0.98 | 0.53 | 0.02 | Cu | 0.28 | Cr | 0.17 | — | — | 0.45 | Balance | F | | | | Multiple occurrance of wire breaking | | | | | |
| | 7 | 0.45 | 0.55 | 0.35 | — | — | — | — | — | — | 0.00 | Balance | F | | | | Multiple occurrance of wire breaking | | | | | |
| | 8 | 0.60 | 0.30 | 0.05 | — | — | — | — | — | — | 0.00 | Balance | G | Absent | 1.5 μm | 2 | 50 | TPC | 70 | 90 | 748 | 90 |
| Conventional example | 1 | Pure copper material (TPC (0)) | | | | | | | | | | | | | | | | | 0 | 50 | 833 | 100 (Reference) |
| | 2 | Pure aluminum material (ECAL) | | | | | | | | | | | | | | | | | 100 | 100 | 663 | 113 |

From the results presented in Tables 1-1 and 1-2, in all of the movable cables of Examples 1 to 28, since a specific aluminum alloy material (first conductor) having high strength and excellent flexural fatigue resistance was used as the conductor such that the area proportion with respect to the whole conductor would be 10% to 100%, the movable cables can be made to have high strength and a light weight compared to the movable cable of Conventional Example 1 in which the conductor was all made of a pure copper material (second conductor). Furthermore, the movable cable also has superior flexural fatigue resistance measured in a harsh repeated bending test with a bend radius of 30 mm. On the other hand, in all of Comparative Example 1 produced using an aluminum alloy material (second conductor) in which the Fe content was out of the appropriate range of the present invention, Comparative Example 2 produced using an aluminum alloy material (second conductor) in which the contents of Mg and Si were out of the appropriate ranges of the present invention, and Comparative Example 3 produced using an aluminum alloy material (second conductor) in which the total content of Cu and Cr was out of the appropriate range of the present invention, since breaking of wire occurred at the time of wire drawing, a movable cable could not be produced. Furthermore, the movable cable of Comparative Example 4 in which the average value of a dimension perpendicular to the longitudinal direction of the crystal grains was 510 nm and was out of the appropriate range of the present invention, had inferior flexural fatigue resistance. Furthermore, in the movable cable of Comparative Example 5 produced using an aluminum alloy material (second conductor) not containing Fe, the average value of a dimension perpendicular to the longitudinal direction of the crystal grains was 470 nm and was out of the appropriate range of the present invention, and the movable cable had inferior flexural fatigue resistance. Furthermore, in Comparative Examples 6 and 7, cold wire drawing [1] was carried out after an aging precipitation heat treatment at a treatment temperature of 180° C. for a retention time of 10 hours had been applied; however, since breaking of wire occurred many times, a movable cable could not be produced. In addition, the movable cable of Comparative Example 8 in which the average value of a dimension perpendicular to the longitudinal direction of the crystal grains was 1.5 μm and was out of the appropriate range of the present invention, had inferior flexural fatigue resistance. Furthermore, the movable cable of Conventional Example 2 produced using a second conductor formed from a pure aluminum material (ECAL) was lightweight compared to the movable cable of Conventional Example 1; however, since the strength of the conductor was low, the number proportion of required tension members was large, and therefore, the effect of weight reduction was diminished. In addition, the flexural fatigue resistance was markedly inferior.

EXPLANATION OF REFERENCE NUMERALS

1 FIRST INSULATION COATED CORE
2 FIRST CONDUCTOR
3 SECOND CONDUCTOR
4 SECOND INSULATION COATED CORE
5 THIRD INSULATION COATED CORE
6, 6A INTERPOSED BODY (OR TENSION MEMBER)
7, 7A TO 7E COMPOSITE TWISTED WIRE (UNIT)
8 INSULATOR
9 SHEATH
10, 10A TO 10H MOVABLE CABLE

The invention claimed is:

1. A movable cable having a conductor therein, the conductor including a first conductor formed from a specific aluminum alloy material having an alloy composition containing, by mass %, 0.05% to 1.8% of Mg, 0.01% to 2.0% of Si, 0.01% to 1.5% of Fe, and 0.00% to 2.00% in total of one or more elements selected from the group consisting of Cu, Ag, Zn, Ni, Co, Au, Mn, Cr, V, Zr, Ti, and Sn, with the balance being Al and unavoidable impurities, the specific aluminum alloy material having a fiber-like metal structure in which crystal grains extend to be aligned in one direction, and in a cross-section parallel to the one direction, an average value of a dimension perpendicular to a longitudinal direction of the crystal grains is 400 nm or less, an aspect ratio L1/L2 between a longitudinal direction dimension L1 measured along the longitudinal direction and a lateral direction dimension L2 measured along a direction perpendicular to the longitudinal direction is 10 or greater, and the dimension measured along the longitudinal direction of the crystal grains existing in the specific aluminum alloy material is 1,200 nm or more, wherein an area proportion occupied by the first conductor in a whole area occupied by all conductors of the movable cable as viewed from a transverse cross-section of the movable cable is in a range of 10% to 100%, wherein the conductor includes:

a first type of insulation coated core obtained by twisting a plurality of the first conductors, and insulative coating the twisted first conductors;

a second type of insulation coated core obtained by mixing a plurality of the first conductors and a plurality of second conductors formed from a metal material or an alloy material selected from the group consisting of copper, copper alloy, aluminum, and aluminum alloy, twisting the mixed conductors, and insulative coating the twisted first and second conductors; and a third type of insulation coated core obtained by twisting a plurality of the second conductors formed from a metal material or an alloy material selected from the group consisting of copper, copper alloy, aluminum, and aluminum alloy, and insulative coating the twisted second conductors, and wherein the movable cable is composed of one or more cables, each cable comprising:

one or more composite twisted wires formed by twisting a plurality of insulation coated cores which include at least one insulation coated core of the first type of insulation coated core and the second type of insulation coated core among the first type of insulation coated core, the second type of insulation coated core, and the third type of insulation coated core such that the area proportion of the first conductor reaches one level or higher; and a sheath insulative coating the composite twisted wires so as to include them.

2. The movable cable according to claim 1, wherein the specific aluminum alloy material has an alloy composition containing, by mass %, 0.2% to 1.8% of Mg, 0.2% to 2.0% of Si, 0.01% to 1.5% of Fe, and 0.00% to 2.00% in total of one or more elements selected from the group consisting of Cu, Ag, Zn, Ni, Co, Au, Mn, Cr, V, Zr, Ti, and Sn, with the balance being Al and unavoidable impurities.

3. The movable cable according to claim 1, wherein the movable cable is an elevator cable.

4. The movable cable according to claim 1, wherein the movable cable is a robot cable.

5. The movable cable according to claim 1, wherein the movable cable is a cabtire cable.

6. The movable cable according to claim 1, wherein the first conductor and the second conductor have the same dimension as viewed from a transverse cross-section of the movable cable.

* * * * *